US005115620A

United States Patent [19]

Takamura

[11] Patent Number: 5,115,620

[45] Date of Patent: May 26, 1992

[54] WRAPPING MACHINE

[75] Inventor: Yoshiyuki Takamura, Nagoya, Japan

[73] Assignee: Fuji Pack System Ltd., Nagoya, Japan

[21] Appl. No.: 584,086

[22] Filed: Sep. 18, 1990

[30] Foreign Application Priority Data

| | | | |
|---|---|---|---|
| Sep. 18, 1989 | [JP] | Japan | 1-109237 |
| Sep. 18, 1989 | [JP] | Japan | 1-109238 |
| Sep. 18, 1989 | [JP] | Japan | 1-243166 |
| Sep. 20, 1989 | [JP] | Japan | 1-244647 |
| Sep. 20, 1989 | [JP] | Japan | 1-244648 |
| Oct. 27, 1989 | [JP] | Japan | 1-280190 |
| Feb. 20, 1990 | [JP] | Japan | 2-40713 |
| Feb. 20, 1990 | [JP] | Japan | 2-40714 |
| Feb. 27, 1990 | [JP] | Japan | 2-20319 |

[51] Int. Cl.[5] ..... B65B 11/18; B65B 59/00

[52] U.S. Cl. ..... 53/64; 53/556; 53/222; 53/389.2; 53/66

[58] Field of Search ..... 53/64, 556, 222, 223, 53/389.2, 389.4, 52, 504

[56] References Cited

U.S. PATENT DOCUMENTS

| | | | |
|---|---|---|---|
| 2,729,042 | 1/1956 | Brook | 53/389.2 |
| 3,541,435 | 11/1970 | Foster | 53/504 |
| 4,178,740 | 12/1979 | Groom | 53/556 |
| 4,501,106 | 2/1985 | Treiber | 53/556 |
| 4,589,348 | 4/1986 | Treiber | 53/556 |
| 4,631,903 | 12/1986 | Takamura | 53/556 |

FOREIGN PATENT DOCUMENTS

| | | | |
|---|---|---|---|
| 12091 | 1/1977 | Japan | 53/504 |
| 52-132984 | 11/1977 | Japan . | |
| 55-20927 | 9/1980 | Japan . | |
| 56-28766 | 9/1981 | Japan . | |
| 57-175537 | 10/1982 | Japan . | |
| 59-124226 | 7/1984 | Japan . | |
| 59-163112 | 9/1984 | Japan . | |
| 6013887 | 4/1985 | Japan . | |
| 61-60429 | 3/1986 | Japan . | |
| 62-122917 | 6/1987 | Japan . | |
| 62-193910 | 8/1987 | Japan . | |
| 63-149510 | 6/1988 | Japan . | |
| 1-99909 | 4/1989 | Japan . | |

*Primary Examiner*—John Sipos

*Attorney, Agent, or Firm*—Oblon, Spivak, McClelland, Maier & Neustadt

[57] ABSTRACT

A wrapping machine of the present invention comprises a wrapping portion for wrapping a material, a film feeder for feeding a wrapping material (film) to the wrapping portion from a film roller, a material feeder for feeding the material to the wrapping portion, a film folding device for wrapping the material with the film at the wrapping portion, and a material transfer device for transferring the wrapped material. When a material is placed on a conveyer of the material feeder, the material abuts on a stopper to temporarily stop, and then is transferred to a lift of the material feeder. The width and length of the material are detected during the transfer. The lift then moves upward to supply the material to the wrapping portion. The film drawn from the film roller by the film feeder is supplied to the wrapping portion where the material abuts on the film from below so that the upper portion of the material is covered with the film. The film is then folded under the material by the film folding device. The material is wrapped and then transferred by the material transfer device.

4 Claims, 15 Drawing Sheets

6
113
113a
112
114
114a
114b
115
116
120
26a(26)
26b
27a(27)
27b
W
R
R'
L
θ

103
112
101
102
35
34
54
55
43
49
46
57a
85
200
69
64
66. 68
86
44
87
23
3
15
10

103
112
101
102
35
34
54
55
85
43
44
87
86
49
46
57a
23
69
64
66.68
3
15
10

WRAPPING MACHINE

BACKGROUND OF THE INVENTION

The present invention is directed to a wrapping machine for wrapping a tray.. having fresh food or the like placed thereon with a stretchable film. More particularly, this invention relates to a wrapping machine which folds a wrapping film covering the top of a tray under the tray to wrap it.

One conventional wrapping machine is disclosed in, for example, Japanese laid open patent No. 52-132984. This wrapping machine is equipped with a film feeder which feeds a film drawn from a film roller of a film roller support to a wrapping portion. This wrapping machine also has a material lift device, which carries up or down a tray received below the wrapping portion and causes the film in the wrapping portion to abut on the tray to lift the film with the upward/downward elevation, and a material conveyor device which feeds a tray onto a material lift of this lift device.

Further, the prior art wrapping machine is provided with a film folding device, which enables a rear folder to move closer to and away from a front folder secured at the wrapping portion and side folding arms to open and close with the movement of the rear folder thereby to fold the film under the tray. The wrapping machine further comprises a heater located next to the front folder of the film folding device on the transfer side, and a material transfer device located above the film folding device.

When the film is folded against the tray by the individual folders and side folding arms in the wrapping machine, the edges of the film are held to permit the film to be stretched under the tray by the folders and side folding arms and to be folded there while applied with tension. In this case, insufficient tension is liable to wrinkle the film and overstretching the film is likely to tear the film. It is therefore important to adjust the tension of the film to the tray in order to provide an excellent wrapping state.

Since the film is made of a synthetic resin, its elongation varies with changes in the atmospheric temperature. The tension of the film to the tray is therefore greatly affected by such change in the atmospheric temperature, making it difficult to keep a good wrapping state.

The film feeder of the wrapping machine disclosed in the aforementioned Japanese laid open Patent No. 52-132984 has a fixed film holder for holding the leading edge of the film fed out from the film roller and a movable film holder to move closer to or away from the fixed film holder to hold the leading edge of the film on the fixed film holder. In the vicinity of this fixed film holder is a support bar rotatably supported, with a pressing plate attached to the upper end of the support bar. The film is drawn from the fixed film holder by the movable film holder, and the film in this state is held by the pressing plate near the fixed film holder.

According to the above-described film feeder, however, the support bar with the pressing plate attached thereto rotates to hold the film, thus requiring a link mechanism to cause the rotation. This makes the wrapping machine large-scaled due to the space needed for the link mechanism as well as complicates the overall structure.

The movable film holder disclosed in the aforementioned publication has an openable and closable holding portion which is opened or closed by a drive section directly secured to the movable film holder.

Since the drive section moves integrally with the movable film holder, however, another device cannot be provided on the moving locus of the drive section in order to avoid interference with the drive section. It has therefore not been possible to efficiently utilize the space above the moving locus. Thus the wrapping machine must be relatively large, which is disadvantageous.

According to the above prior art wrapping machine, it is not possible to detect if the film is actually drawn from the film roller by a predetermined length, nor is it possible to detect if the drawn film is actually supplied to the wrapping portion by the film feeder. Even when the desired length of the film is not supplied to the wrapping portion, the film folding motions will continue. In such a case, the tray may not have been wrapped with the film or the wrapping may have been done incompletely.

The film roller support used in the conventional wrapping machine is exemplified in FIGS. 15 and 16. This support has a pair of supporting rollers 32 and 33 rotatably provided in parallel to support a film roller 34, so that a film 35 drawn from the film roller 34 is drawn upward, passing between the supporting rollers 32 and 33 or around the supporting roller 32, as indicated by the one-dot chain line in FIG. 15.

The leading edge of this film 35 is held by a fixed film holder 43. When the leading edge of the film 35 is pulled toward a wrapping portion by the fixed film holder 43, the film roller 34 rotates in the direction of the arrow 121 and both the supporting rollers 32 and 33 rotate in the direction of the arrow 122.

Even if drawing of the film 35 from the fixed film holder 43 is completed, however, the film roller 34 and supporting rollers 32 and 33 may rotate due to the inertia. In this case, a mid portion 35*a* of the film 35 may be caught between the film roller 34 and the supporting roller 33 as indicated by the two-dot chain line in FIG. 15 or a mid portion 35*b* of the film 35 wound around the supporting roller 32 may be caught between the film roller 34 and supporting roller 32 as shown in Fig. 16, possibly hindering the drawing of the film To provide a good wrapping state, the above wrapping machine requires that the length of a film in use and the timings for holding, releasing and/or cutting the film be adjusted in accordance with the size of a material. Such adjustments are premised that the size of the material should accurately be detected.

The width of a material along the conveying direction of the material can be computed by a product of the OFF time of a photoelectric switch, which is switched off while the material is passing it, and the material transfer velocity, as disclosed in Japanese laid open Patent No. 62-122917, for example.

The length of a material along a direction orthogonal to the conveying direction of the material may be computed by providing a pair of guide bars whose interval can be adjusted in accordance with the size of a material and which guide both sides of the material during transfer, and detecting the interval between both guide bars by means of a potentiometer, as disclosed in Japanese laid open Patent No. 62-193910, for example. The use of this detection means, however, requires adjustment of the interval between the guide bars for each material, making the interval adjustment originating from alteration of the material troublesome.

Alternatively, providing a plurality of photoelectric switches in parallel on the line orthogonal to the conveying direction of a material is proposed as disclosed in Japanese laid open Patent No. 63-149510. Although this detection means can automatically detect the length of a material based on the ON/OFF status of each photoelectric switch, its structure is inevitably complicated due to the necessity of a number of photoelectric switches.

A material feeder of a wrapping machine of the same type as the wrapping machine disclosed in the aforementioned Japanese laid open Patent No. 52-132984 is described in Japanese laid open Patent No. 59-124226, for example. According to the conveyor of the material feeder, placing a material on a material support activates the overall wrapping machine and rotates a conveying belt having a circular cross section (hereinafter called "round belt") located below the material support. When a lift moves down to a material receiving position at one end of the belt, a round belt mounting frame moves above the material support to cause the belt to contact the material and the material is conveyed onto the lift by the belt. When the material is separated off the material support, the round belt mounting frame moves back downward and the belt is positioned below the material support.

According to the above conveyor, the belt moves upward together with the belt mounting frame with the downward movement of the lift, thereby conveying a material. As long as an operator places a material accurately on the material support, therefore, the material is conveyed in synchronism with the elevation timing of the lift to accurately place the material on the lift. If the operator erroneously places a material partially protruding from the material support, the material may contact the rotating belt to be conveyed regardless of the elevation timing of the lift, and is liable to hit the lift.

According to the conventional conveyor, as described above, while the timing for placing a material on the support is in no way restricted, the material may be carelessly conveyed due to negligence of an operator.

The wrapping machine disclosed in the aforementioned Japanese laid open Patent No. 52-132984 is provided with a lift which moves upward and downward with a material received below a wrapping portion, and a conveyor for supplying a material onto the lift. When the lift having a material placed thereon moves upward, the material abuts on a film supplied to the wrapping portion, from below, and the material is covered with the film from above. This film is folded under the material, and the wrapped material is then transferred.

Since a mechanism for elevating the lift upward and downward is linked to the bottom of the lift under the conveyor, however, it is necessary to provide space for this elevating mechanism below the conveyor. This inevitably requires that the position of the conveyor and the lowest elevating position of the lift be set high, thus enlarging the overall wrapping machine.

According to the wrapping machine disclosed in the aforementioned Japanese laid open Patent No. 52-132984, every time a single tray is supplied, a wrapping machine drive signal is outputted to activate the wrapping machine. When the wrapping machine is intermittently activated by continuous supply of trays, the first tray supplied is transferred when the third tray is supplied. When there is no tray supplied, the drive signal is not outputted to deactivate the wrapping machine, leaving trays unwrapped in the wrapping machine. In this case, there requires a troublesome operation to press a manual switch to activate the wrapping machine to transfer the trays left therein.

SUMMARY OF THE INVENTION

It is a primary object of the present invention to control the tension of a film in accordance with a change in the atmospheric temperature to always maintain a good wrapping state.

To achieve this object, a wrapping machine of the present invention comprises a wrapping portion for wrapping a material, a film feeder for feeding a wrapping material (hereinafter referred to as "film") to the wrapping portion, a material feeder for feeding the material to the wrapping portion, a film folding device for wrapping the material with the film at the wrapping portion, and a material transfer device for transferring the wrapped material.

According to this invention, the wrapping machine further comprises a holding means for holding the film fed to the film feeder, a drive means for permitting the holding means to hold or release the film, a sensor for detecting an actual atmospheric temperature, a memory means for storing a drive timing of the drive means according to a preset temperature, and a drive control means for reading out the drive timing of the drive means corresponding to a detected atmospheric temperature from the memory means based on a detection signal from the temperature sensor, and driving the drive means at the drive timing to release holding of the holding means.

According to such a film tension controller, the timing for releasing the holding of the film and the timing for folding the film can be changed relatively in accordance with the actual atmospheric temperature. Therefore, the film can be folded under a material to be wrapped with the optimal tension, minimizing wrinkle formed at the folded portion of the wrapped material.

It is a second object of the present invention to provide a wrapping machine designed to be compact by improving a mechanism for pressing a film at the time of folding it Another aim is to eliminate the link mechanism required in conventional wrapping machine, to simplify the structure and make the wrapping machine more compact.

To achieve this object, according to the present invention, a film feeder has a fixed film holder for holding a leading edge of a film drawn from a film roller, and a movable film holder to move closer to and away from the fixed film holder to hold a leading edge of the film on the fixed film holder, and the fixed film holder has a pair of guide rollers provided rotatable for holding the film, a holding portion for holding a leading edge of the film between the guide rollers, and a brake for hindering rotation of at least one of the guide rollers.

According to this invention, at the wrapping time, the film is held by the movable film holder and is guided by both the guide rollers. At the folding timing, the holding of the film by the movable film holder is released and the brake is released to release the holding by the guide rollers.

When the movable film holder is moved away from the fixed film holder, the film held by the movable film holder is pulled out from the fixed film holder. The brake is first activated to permit the film to be held between the guide rollers, and then the drive section stops to stop the movable film holder at a position apart from the fixed film holder according to the width of the material. The film therefore is stretched between both the film holders, pulled by the movable film holder after stopping of the brake.

The above design can simplify the structure of the film pressing mechanism, and can make the wrapping material feeder, and the film as a consequence, compact. Further, the film can accurately be stretched without looseness between both the film holders.

It is a third object of the present invention to provide a film designed to be compact by improving the movable film holder of the film feeder and to contrive the attaching position of the drive section for opening and closing the holding portion of the movable film holder as well as an interlocking means between the drive section and the holding portion, thereby making the movable film holder compact and the film compact as a consequence.

To achieve this object, according to the present invention, a film feeder has a fixed film holder for holding a leading edge of a film, a movable film holder having an openable and closable holding portion to move closer to and away from the fixed film holder to hold a leading edge of the film on the fixed film holder, a drive motor for opening and closing the holding portion, with an interlocking means, provided between the drive means and the holding portion of the movable film holder, for opening and closing the holding portion.

According to this invention, when the movable film holder moves closer to or away from the fixed film holder, the drive motor is prevented from moving concurrently. The holding portion of the movable film holder is opened and closed by the drive motor through the interlocking means. The holding of the film can be released according to the timing for folding the film.

Even when the movable film holder moves, therefore, the drive section for opening and closing the holding portion of the movable film holder does not interfere with other devices and space can be effectively used accordingly, thus making it possible to design the movable film holder compact and the film compact as a consequence.

It is a fourth object of the present invention to provide a device capable of detecting the length of a wrapping material drawn irrespective of a volume change of the film of a film roller, and a device for checking whether or not a predetermined length of a film is supplied to a wrapping portion.

To achieve this object, a wrapping machine according to the present invention comprises a drawn-length detecting means for detecting a drawing length of a film drawn from a film roller with driving of a film feeder, a memory means for storing in advance a drawing length of the film from the film roller based on a detection signal concerning a size of the material, and a drive control means for comparing an actual drawing length of the film detected by the drawn-length detecting means with the drawing length of the film read out from the memory means in association with the detection signal concerning the size of the material and for stopping the wrapping machine when the drawing lengths do not coincide with each other.

When the actual length of the film drawn does not coincide with the length of the film prestored in accordance with the size of a material, the wrapping machine stops functioning.

It is therefore possible to stop the wrapping machine or keep it activated after checking if a predetermined length of the film is actually drawn. This prevents a material to be wrapped from being discharged, unwrapped or incompletely wrapped.

It is a fifth object of the present invention to prevent a film from being caught to thereby surely draw the film.

To achieve this object, a wrapping machine according to the present invention is provided with a film roller support, having a pair of supporting rollers rotatably provided in parallel for supporting a film roller, for permitting the film drawn from the film roller to be wound around that supporting roller to be drawn to the film feeder, and a resistance applying device for applying a rotational resistance to at least one of the supporting rollers.

When the film is drawn from the film roller, therefore, the film roller rotates on the supporting rollers as the latter rollers rotate. When the drawing of the film is completed, the film roller is applied with the inertia rotational moment. Since the supporting rollers are applied with the rotational resistance, however, the inertia rotation of the film roller decreases, thus reducing the possibility of the film being caught between the film roller and the supporting rollers.

It is therefore possible to prevent a film from being caught between the film roller and the supporting rollers and to surely draw the film.

It is a sixth object of the present invention to provide a device capable of automatically detecting the length of a material more easily.

To achieve this object, according to the present invention, a material feeder is provided with a conveyor for linearly conveying a material in one direction, a width detecting means for detecting the width of the material along the conveying direction of the material, and a length detecting means for detecting the length of the material along a direction orthogonal to the conveying direction of the material. In addition, the length detecting means includes a sensor for emitting and receiving a light or an ultrasonic wave in and from a direction inclined by a predetermined angle $\theta$ with respect to the conveying direction of the material and an arithmetic operation section for computing a length L of the material from an equation:

$$L=(R-W)/\tan\theta$$

where W is the width of the material detected by the width detecting means and R is a transfer distance of the material detected by the sensor.

In this case, with a material transfer velocity of the conveyor being denoted by V, a material detecting time acquired by a sensor for emitting and receiving a light or an ultrasonic wave in and from a direction orthogonal to the material conveying direction being denoted by Ta, and a material detecting time acquired by the aforementioned sensor being denoted by Tb, the transfer distance R can be acquired by a product of the transfer velocity V and the material detecting time Tb. Further, the width of a material, W, can be obtained by a product of the transfer velocity V and the material detecting time Ta. In other words, the above equation can be expressed as:

$$L=V(Tb-Ta)/\tan\theta$$

The arithmetic operation section can compute the length L of a material by simply attaching the length detector for emitting and receiving a light or an ultrasonic wave in and from a direction inclined by a predetermined angle $\theta$ with respect to the material conveying direction to the conveyor. Therefore, not only the length L of a material can be automatically detected, but also the structure of the material size detecting device can be greatly simplified.

It is a seventh object of the present invention to provide a material feeder which can surely transfer a material in synchronism with an elevation timing of a lift without restricting the timing for placing a material on the lift.

To achieve this object, according to the present invention, a material feeder has a lift elevatable upward and downward with the material below the wrapping portion, for causing the material to abut on the film in the wrapping portion with the upward/downward elevation and to lift up the film, and a conveyor for supplying the material onto the lift. Further, a material detector is provided at a front end of the conveyor to detect the material on the conveyor, a stopper is provided between the material detector and the lift in a manner movable above the conveyor, the stopper and the lift are driven via an interlocking portion by a drive motor, and a control section is provided to drive the drive motor in response to a detection signal from the material detector and stop the drive motor in response to a detection signal from a step detector for detecting the driving status of the motor.

When a material is placed at the beginning of the conveyor, the material detector detects the material and the control section drives the motor in response to a detection signal from the detector. When the motor is activated, the conveyor, stopper, the lift, etc. are driven. When the conveyor is driven, the material is sent toward the lift and abuts on the stopper protruding over the conveyor to temporarily stop.

When the lift is located at the receiving position and the stopper retreats under the conveyor in synchronism with this action, the material is again fed and stops at the end of the conveyor.

When the lift moves upward thereafter, the material is moved upward on the lift, a film in the wrapping portion is lifted up by the material and is folded under the material in this state to wrap the material, and the wrapped material is transferred. In accordance with the transfer of the material, the control section stops the drive motor in response to the detection signal from the step detector.

Then, when a material is again placed at the beginning of the conveyor, the material detector detects it and the motor, etc. are driven to convey the material on the conveyor.

The material is therefore always stopped during the transfer by the stopper, and is fed again at the elevation timing of the lift. Accordingly, the timing for placing a material is not restricted and the timing for conveying a material to the lift is determined by the stopper so that the material can surely be supplied onto the lift.

It is an eighth object of the present invention to make a wrapping machine compact by contriving the location of the elevating mechanism for the lift so as to set the location of the conveyor and the material receiving position of the lift lower.

To achieve this object, according to the present invention, a film feeder has a lift elevatable upward and downward with a material below the wrapping portion, for causing the material to abut on the film in the wrapping portion with the upward/downward elevation and to thereby lift up the film, and a conveyor for supplying the material onto the lift, and a mechanism for elevating the lift upward and downward is disposed on either side of the conveyor along a material conveying direction.

According to the present invention, since the mechanism for elevating the lift upward and downward is located on either side of the conveyor, not under it, the location of the conveyor can be set lower and the overall wrapping machine can be made compact accordingly.

It is a ninth object of the present invention to automatically transfer a material.

To achieve this object, a wrapping machine according to the present invention comprises a material detector for detecting a material placed on a material feeder, a step detector for outputting a signal corresponding to timings to start supplying, wrapping and transferring the material, and a control section for outputting a signal to activate the wrapping machine in response to a detection signal of the material detector upon detection of one material and outputting a signal to stop the wrapping machine when a predetermined number of steps has been counted based on a detection signal from the step detector, thereby controlling the wrapping machine to be activated until the predetermined number of steps for one material are completed.

When the material detector detects one material, the wrapping machine is activated to supply, wrap and transfer the material. When the next material is not supplied before a predetermined number of steps for that material are completed, the wrapping machine stops functioning. When the next material is supplied on the other hand by that time, the wrapping machine keeps functioning to work on the next material.

Even when the supplying of materials is interrupted during activation of the wrapping machine, therefore, a material in process is always properly transferred so that the material would not be left in the wrapping machine after the wrapping machine stops, and the material transfer during interruption of supplying materials can be automated, thus improving the working efficiency.

DESCRIPTION OF THE PREFERRED EMBODIMENT

One preferred embodiment of the present invention as applied to a wrapping machine using a stretchable film made of a synthetic resin will now be described referring to the accompanying drawings.

Figure 1:
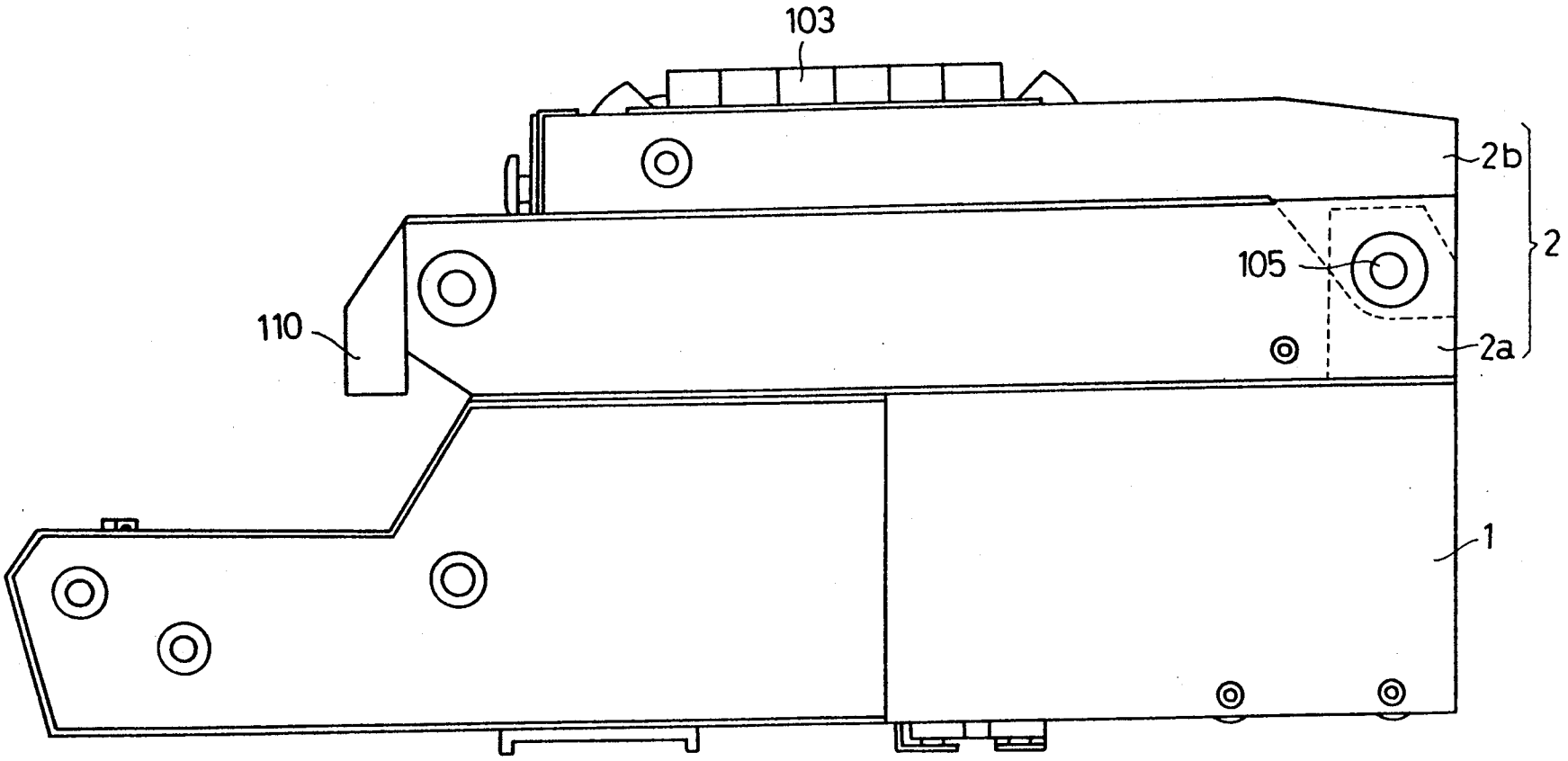
Fig. 1 is a side view of a film wrapping machine.
Figure 2:
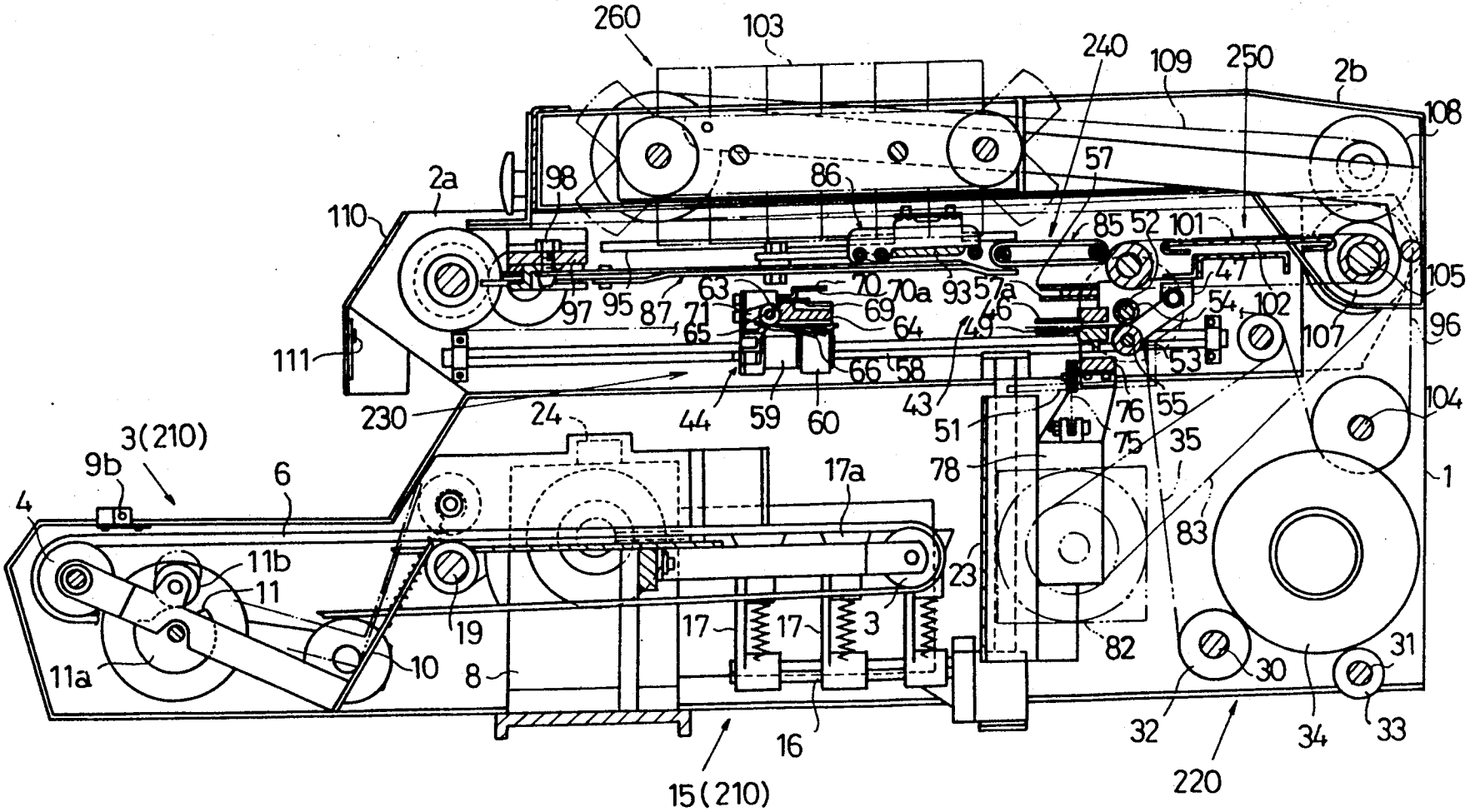
FIG. 2 is a longitudinal cross section of the wrapping machine.
Figure 3:
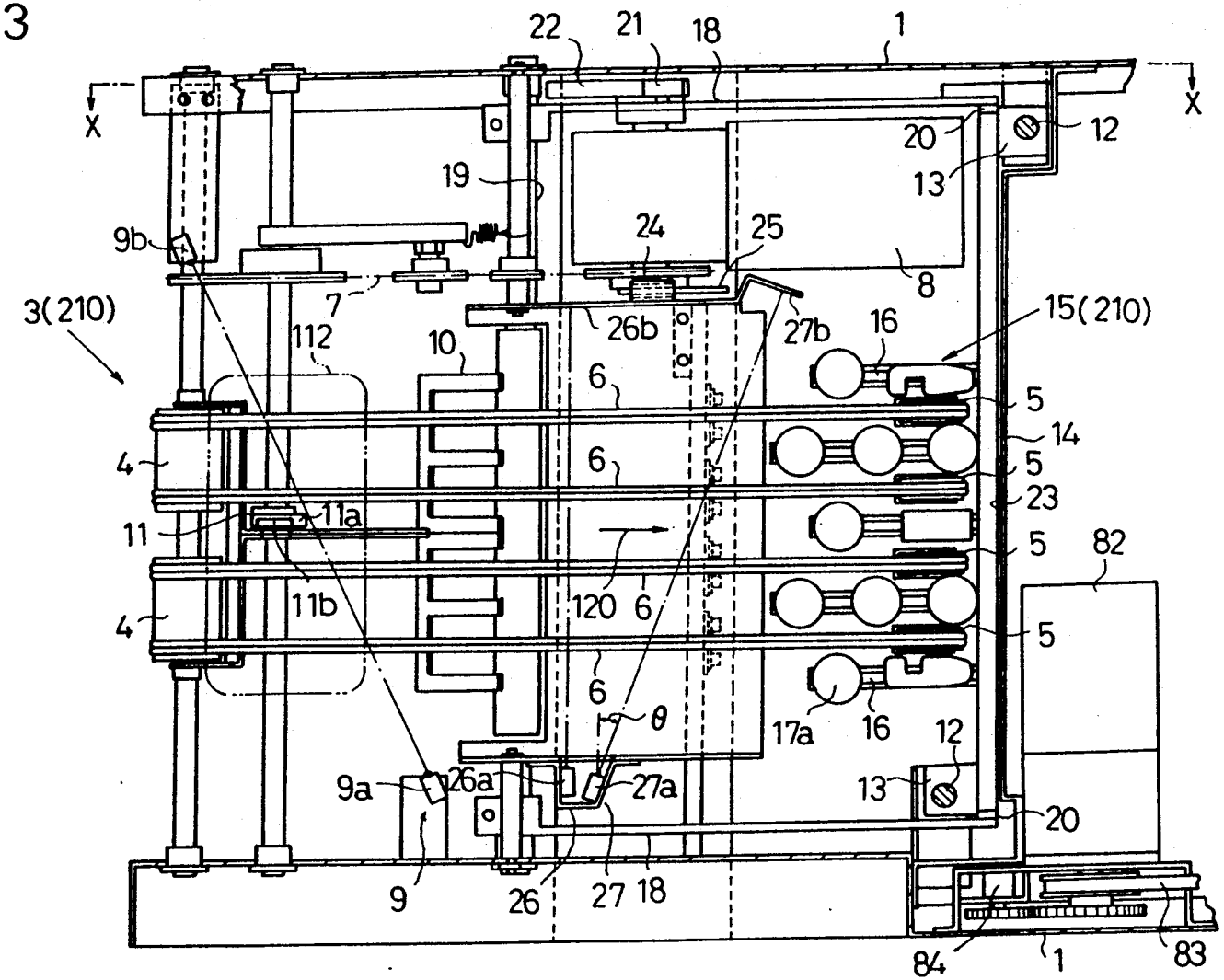
FIG. 3 is a partly lateral cross-sectional view illustrating a material feeder of the wrapping machine.
Figure 4:
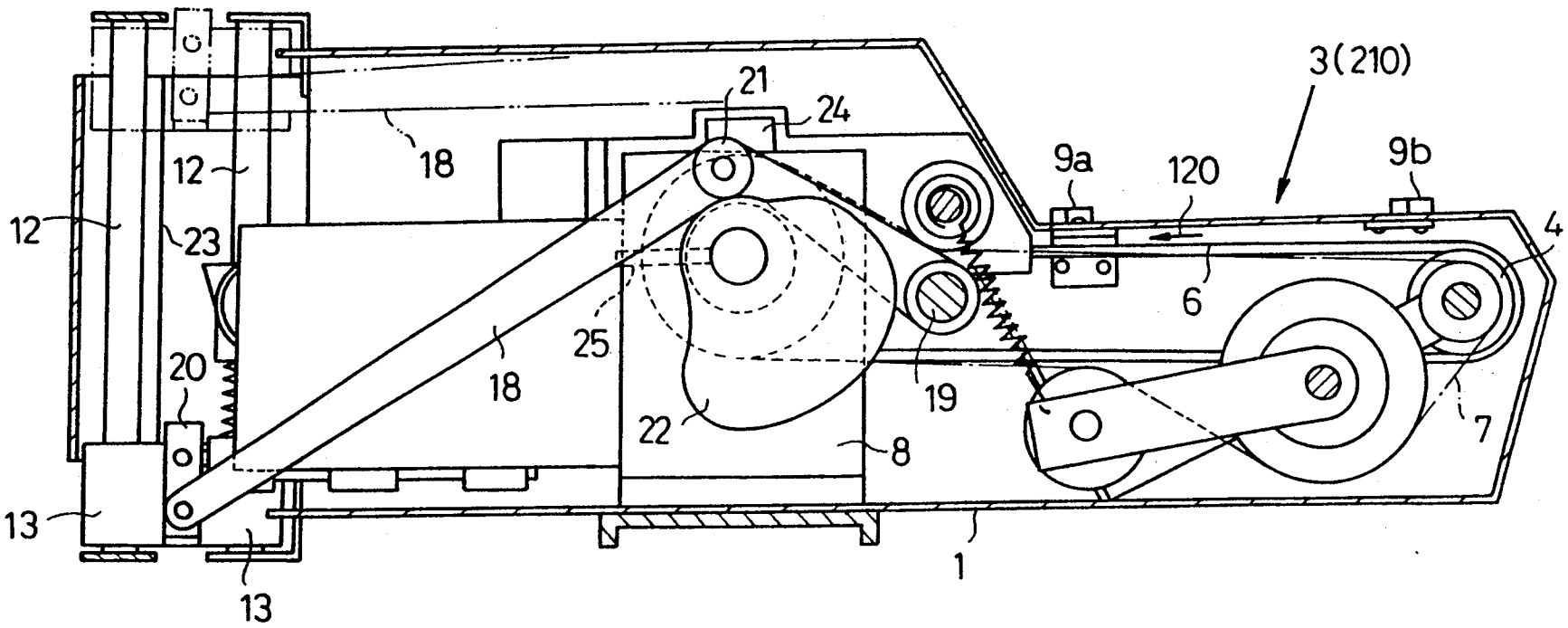
FIG. 4 is a partly cross-sectional view of the material feeder taken along the line X—X in FIG. 3.

As shown in FIGS. 1 and 2, a wrapping machine is divided into a lower frame 1 and an upper frame 2. The upper frame 2 is separated into a fixed section 2*a* and a pivotable section 2*b*. The upper frame 2 is supported at the front end of the fixed section 2*a* in a manner pivotable to the upper front edge of the lower frame 1, and is openable and closable to cover the top of the lower frame 1. The pivotable section 2*b* of the upper frame 2 is supported at its front end in a manner pivotable to the front end of the fixed section 2*a* to cover the fixed section 2*a* in an openable and closable manner. As shown in FIGS. 2, 3 and 4, a material feeder 210 is disposed at the rear of the lower frame 1. This material feeder 210 will now be described in detail.

A conveyor 3 having a plurality of belts 6 with a circular cross section set between pulleys 4 and 5 is rotated via an interlocking chain by a drive motor 8 with a decelerator. An optical sensor 9 is provided at the beginning of the conveyor 3. This sensor 9 is a photoelectric switch, which comprises a light-emitting element 9*a* and a light-receiving element 9*b* and emits light in a direction inclined with respect to a material conveying direction 120 A comb-shaped stopper 10 is supported on a closer material conveying side than the sensor 9 to be thrustable forward and backward over belts 6 of the conveyor 3. The stopper 10 is driven via the interlocking chain 7 and a cam mechanism 11 (including a cam plate 11*a* and a cam roller 11*b*) by the drive motor 8.

Guide rods 12 are protrusively provided on the respective sides of the conveyor 3 at the ends thereof, with slide blocks 13 fitted slidable in the up-and-down direction in the guide rods 12. A support bar 14 is attached between the slide blocks 13. Mounted to the support bar 14 is a lift 15, which comprises a plurality of support arms 16 secured to the support bar 14 and a plurality of arms 17 protrusively provided on the support arms 16. A head 17*a* is supported inclinable on the top of each support arm 17.

Interlocking levers 18 having a near L-shape are secured to both end portions of a rotary shaft 19 on the respective sides of the conveyor 3, with their free ends connected via intermediate links 20 to the respective ends of the support bar 14. Cam rollers 21 are supported at mid portions of the interlocking levers 18 and slidably abut on cam plates 22 which are rotated by the drive motor 8.

When the cam plates 22 are rotated by the drive motor 8, both interlocking levers 18 are inclined in the up-and-down direction through the cam rollers 21. The inclining movement is transmitted via intermediate links 20 to the slide blocks 13, which in turn move up and down along the guide rods 12. The up-and-down movement also moves the support bar 14 up and down to thereby elevate the lift 15 up and down.

A stopper plate 23 is provided at the end of the conveyor 3, protruding toward the lift 15.

A step detector 24 is attached to the drive motor 8. This detector 24 is a photocoupler which detects a lever 25 that is rotated by the drive motor 8.

On a closer material conveying side than the stopper 10, the conveyor 3 is attached with a width detector 26 and a length detector 27. The width detector 26 is a photoelectric switch comprising an optical sensor 26*a* and a reflecting plate 26*b*. This detector emits light in a direction orthogonal to the material conveying direction 120. The length detector 27 is also a photoelectric switch comprising an optical sensor 27*a* located adjacent to the optical sensor 26*a* on the material conveying side and a reflecting plate 27*b*. This detector 27 emits light in a direction inclined by a predetermined angle $\theta$ to the material conveying side with respect to the material conveying direction 120.

Figure 12:
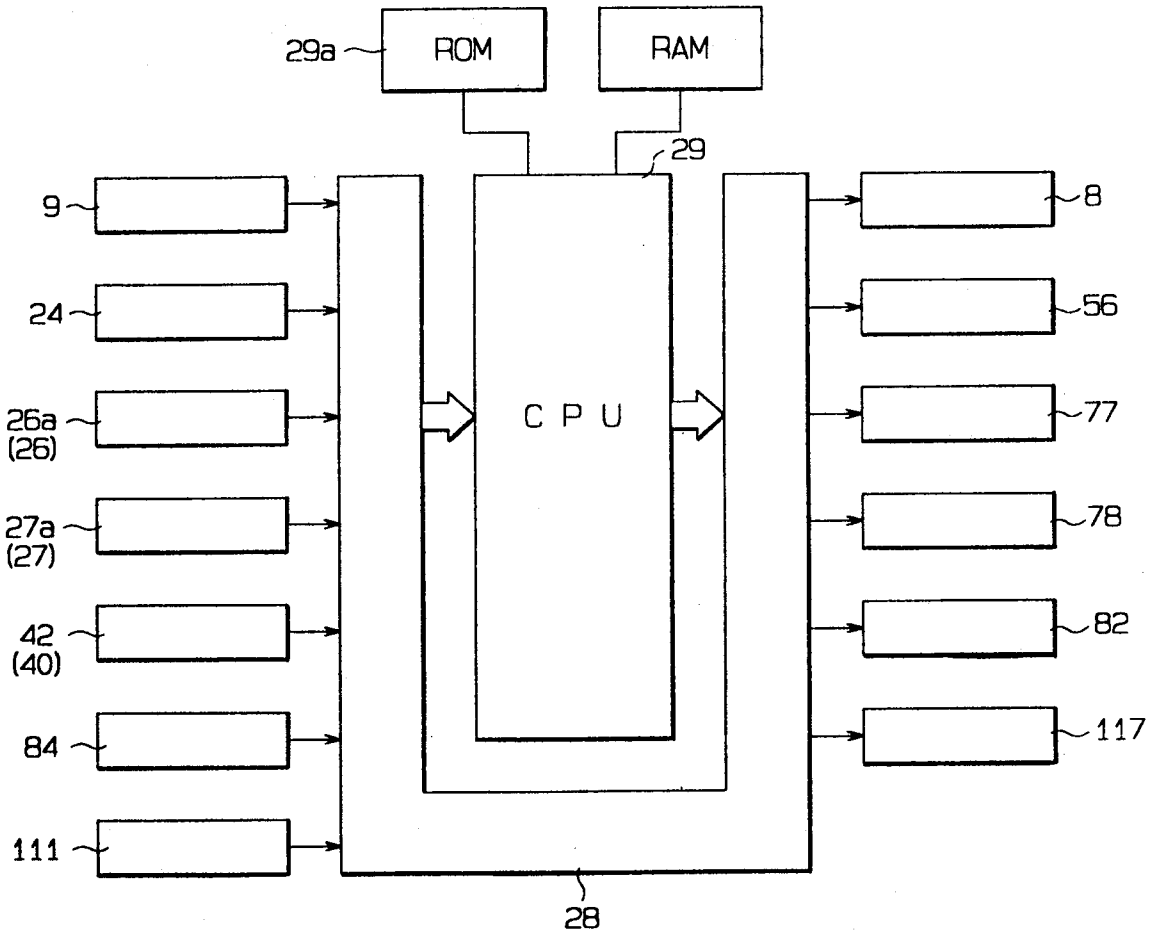
FIG. 12 is an electric circuit block diagram.

The optical sensor 9, step detector 24, width detector 26 and length detector 27 are connected via an input/output (I/0) interface 28 to a CPU 29, as shown in FIG. 12.

Figure 6:
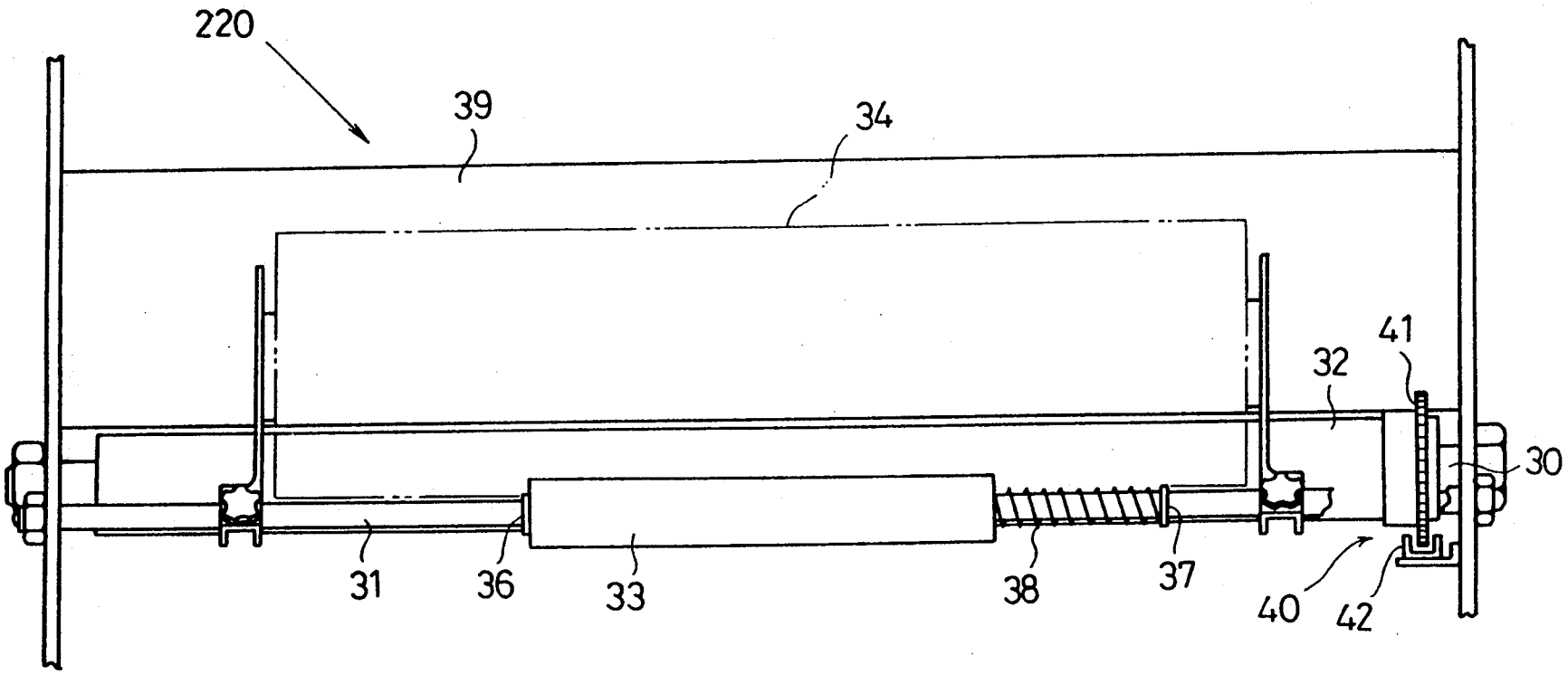
FIG. 6 is a front view of a film roller support.
Figure 7:
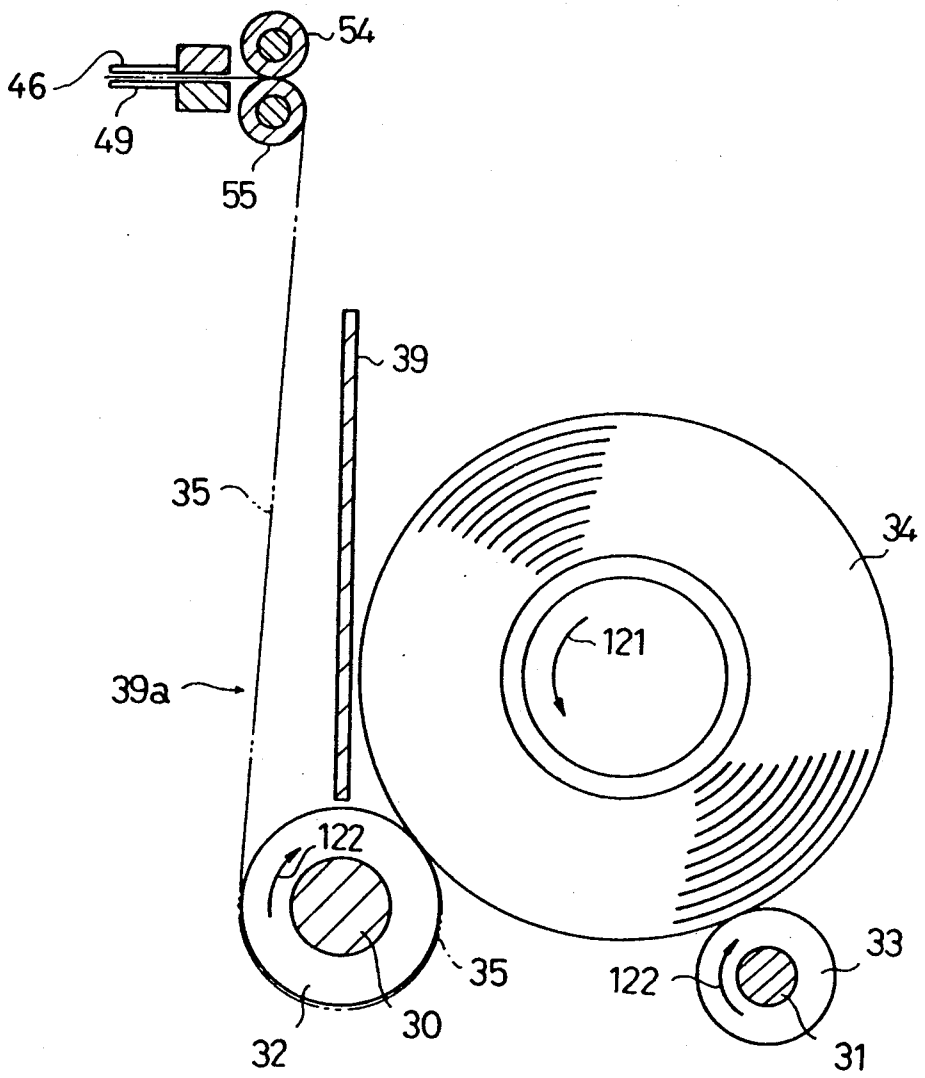
FIG. 7 is a longitudinal cross-sectional view schematically showing the film roller support.

As shown in FIGS. 2, 6 and 7, a film roller support 220 is disposed at the front of the lower frame 1. This film roller support 220 will now be described in detail.

Supporting rollers 32 and 33 are supported rotatable on a pair of parallel fixed shafts 30 and 31, with a film roller 34 supported on the supporting rollers 32 and 33. A film 35 drawn from the film roller 34 is pulled downward between the supporting rollers 32 and 33, and wound around the first supporting roller 32 about half the circumference, then pulled upward passing under the supporting roller 32.

A pair of stop rings 36 and 37 are fitted over the fixed shaft 31, which supports the second supporting roller 33, at a predetermined interval therebetween on the respective sides of this roller 33. A coil spring 38 is wound around the outer circumference of the fixed shaft 31 between one of the stop rings, 37, and one end of the second supporting roller 33. This coil spring 38 urges the second supporting roller 33 toward the other stop ring 36. Accordingly, the second supporting roller 33 is applied with a rotational resistance due to frictional force generated by the coil spring 38, etc.

The coil spring 38 may be wound around the fixed shaft 31 on either side of the second supporting roller 33 to support the roller 33 between both ends thereof and both stop rings 36 and 37.

A dividing plate 39 is secured above the first supporting roller 32, facing the film roller 34. This dividing plate 39 is located between a film path 39*a* where the film 35 passes and the film roller 34, with the lower end of the dividing plate 39 being located near above the first supporting roller 32.

A photoelectric sensor 40 serving as a film drawing length detecting means is provided at one end of the first supporting roller 32. This sensor 40 comprises a timing gear 41 rotatable together with the first supporting roller 32, and a photocoupler 42 which is switched on and off by the projecting and recess portions around the timing gear 41. This photocoupler 42 is connected to the I/0 interface 28 to the CPU 29, as shown in FIG. 12.

Figure 9:
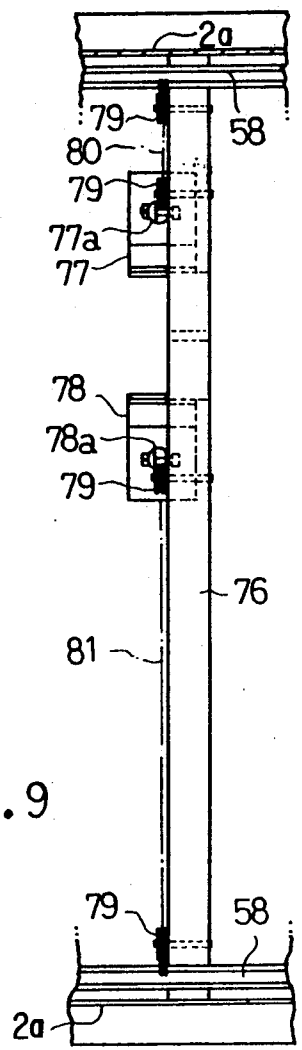
FIG. 9 is a partly cross-sectional view showing a solenoid for opening and closing a holding plate of a movable film holder.
Figure 8:
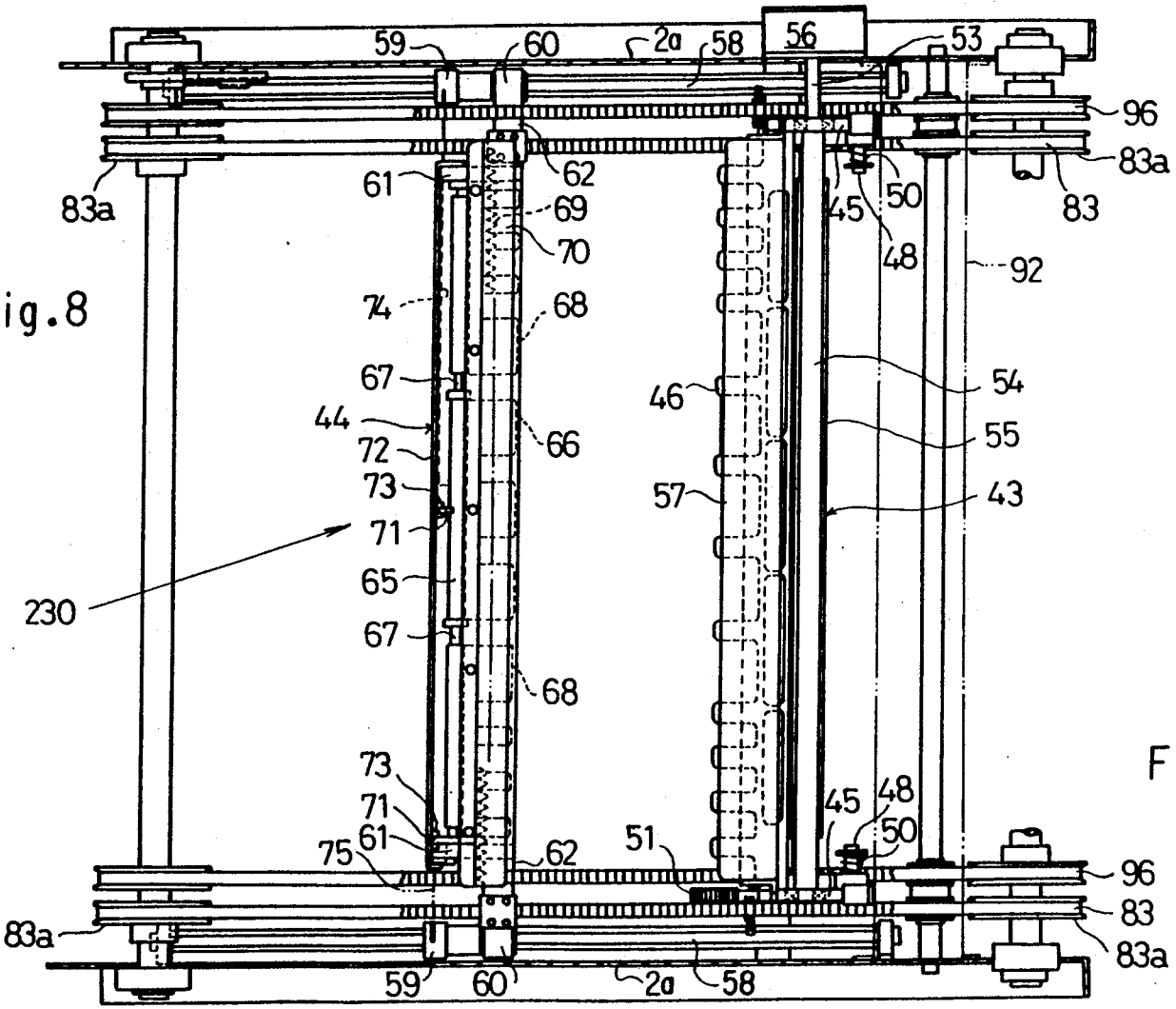
FIG. 8 is a partly cross-sectional view of a film feeder.

As shown in FIGS. 2, 8 and 9, a film feeder 230 is disposed above the lift 15 of the material feeder 210 in the fixed section 2a of the frame 2. This film feeder 230 will be described below in detail.

This film feeder 230 comprises a fixed film holder 43 for holding the leading edge of the film 35 drawn from the film roller 34, and a movable film holder 44 separated close from the fixed film holder 43 to hold the leading edge of the film 35 on the film holder 43.

The fixed film holder 43 has side plates 45 secured to the fixed section 2a of the frame 2, with a comb-shaped, fixed holding plate 46 attached between the side plates 45. Pivot arms 47 are supported rockable on the side plates 45 around support shafts 48, with a comb-shaped movable holding plate 49 attached between the free ends of the pivot arms 47. The pivot arms 47 are urged by torsion springs 50 on the support shafts 48, and this urging force presses the movable holding plate 49 against the fixed holding plate 46 from below. An operating arm 51 is mounted on one of the pivot arms, 47, and pressing this operating arm 51 down rocks both pivot arms 47 and the movable holding plate 48 against the urging force of the torsion springs 50, thus opening between the holding plates 46 and 49.

A pair of an upper shaft 52 and a lower shaft 53 are supported between both side plates 45 and between both pivot arms 47, the upper shaft 52 supported on the side plates 45 being rotatable. The lower shaft 53 supported on the pivot arms 47 are fixed. A cylindrical guide roller 54 is secured to the upper shaft 52, rotatable together. A guide roller 55 is fitted rotatable over the lower shaft 53. Both guide rollers 54 and 55 are pressed together by the urging force of the springs 50. The upper guide roller 54 is made of cork. The upper shaft 52 has one end protruding outside the fixed section 2a to be connected to a brake 56 attached to the outer wall of the fixed section 2a. The leading edge of the film 35 is held between the holding plates 46 and 49, passing between the guide rollers 54 and 55.

A cutter receiver 57 having a cutting groove 57a is attached between the side plates 45 above the holding plates 46 and 49.

As shown in FIGS. 2 and 8, a pair of rotary shafts 58 extending in parallel to the belts 6 are supported on the fixed section 2a, adjacent to the fixed film holder 43. On both rotary shafts 58, a sleeve 59 is fitted movable in the axial direction and rotatable together, and a support sleeve 60 is fitted movable in the axial direction, but not rotatable together. This sleeve 59 is fitted rotatable over the support sleeve 60, which is secured via a connecting portion 62 to side plates 61. Attached between both the side plates 61 is a support bar 63 under which a fixed film holding plate 64 is provided. At the center portion of the support bar 63 is a support sleeve 65 supported rotatable, with a comb-shaped central movable film holding plate 66 mounted on the sleeve 65. A support shaft 67 is supported rotatable on the support bar 63 by the support sleeve 65, and comb-shaped side movable holding plates 68 are mounted rotatable to the support shaft 67 on both sides of the central movable film holding plate 66. The central movable film holding plate 66 and the side movable holding plates 68 rotate individually to be openable and closable to the bottom of the fixed film holding plate 64.

A comb-shaped cutter 69 and a guide plate 70 are mounted on the support bar 63, with a receiving groove 70a formed therebetween.

Interlocking levers 71 are mounted on the support sleeve 65 and support shaft 67, respectively. A pair of guide rollers 73 are supported on a mounting plate 72 attached to the support bar 63. The interlocking lever 71 of the central movable film holding plate 66 and one of the sleeves 59 are connected together via the associated guide roller 73 by a wire 74. The interlocking levers 71 of both the side movable holding plates 68 and the other sleeve 59 are connected together via the guide roller 73 by a wire 75.

As shown in FIG. 9, a support plate 76 is mounted to the fixed section 2a under the fixed film holder 43 and is attached with a pair of solenoids 77 and 78. Both the solenoids 77 and 78 respectively have rods 77a and 77b,which move up and down in accordance with deexcitation and excitation of the solenoids 77 and 78. A pair of guide rollers 79 are supported on the respective sides of the support plate 76 in association with the solenoids 77 and 78. The rod 77a of the solenoid 77 is connected to one rotary shaft 58 via both guide rollers 79 by a wire 80, while the rod 78a of the other solenoid 78 is connected to the other rotary shaft 58 via the guide rollers 79 by a wire 81. When the rods 77a and 78a of the solenoids 77 and 78 move up and down, the central movable film holding plate 66 and side movable holding plates 68 are opened and closed with respect to the fixed film holding plate 64 via the wires 80 and 81, the rotary shafts 58, the sleeves 59 and the wires 74 and 75. As illustrated in FIG. 2, a belt 83 is put over a plurality of pulleys 83a disposed in the lower frame 1, and is connected to the connecting portions 62 on the respective sides of the movable film holder 44.. When this belt 83 rotates, the movable film holder 44 moves closer to and away from the fixed film holder 43, so that the holding plates 64, 66 and 68 of the movable film holder 44 overlap the holding plates 46 and 49 of the fixed film holder 43. The cutter receiver 57 of the fixed film holder 43 is inserted in the receiving groove 70a of the guide plate 70 of the movable film holder 44, and the cutter 69 of the fixed film holder 44 is fitted in the cutting groove 57a.

As shown in FIG. 3, a position detecting sensor 84 comprising a rotary encoder is provided at a drive motor 82, and is connected via the I/0 interface 28 to the CPU 29 shown in FIG. 12.

Figure 10:
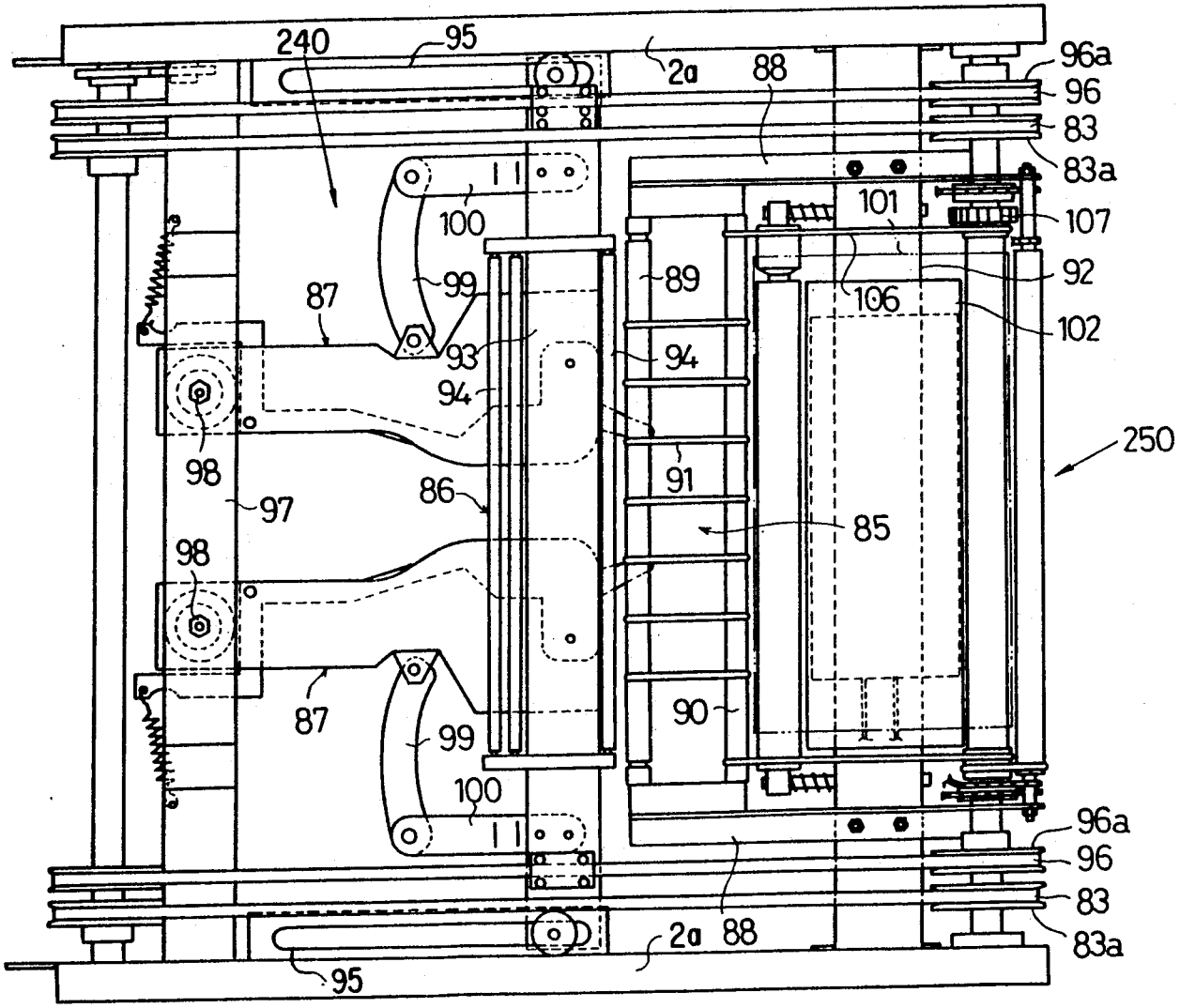
FIG. 10 is a partly cross-sectional view illustrating a film folding device and a heater.
Figure 11:
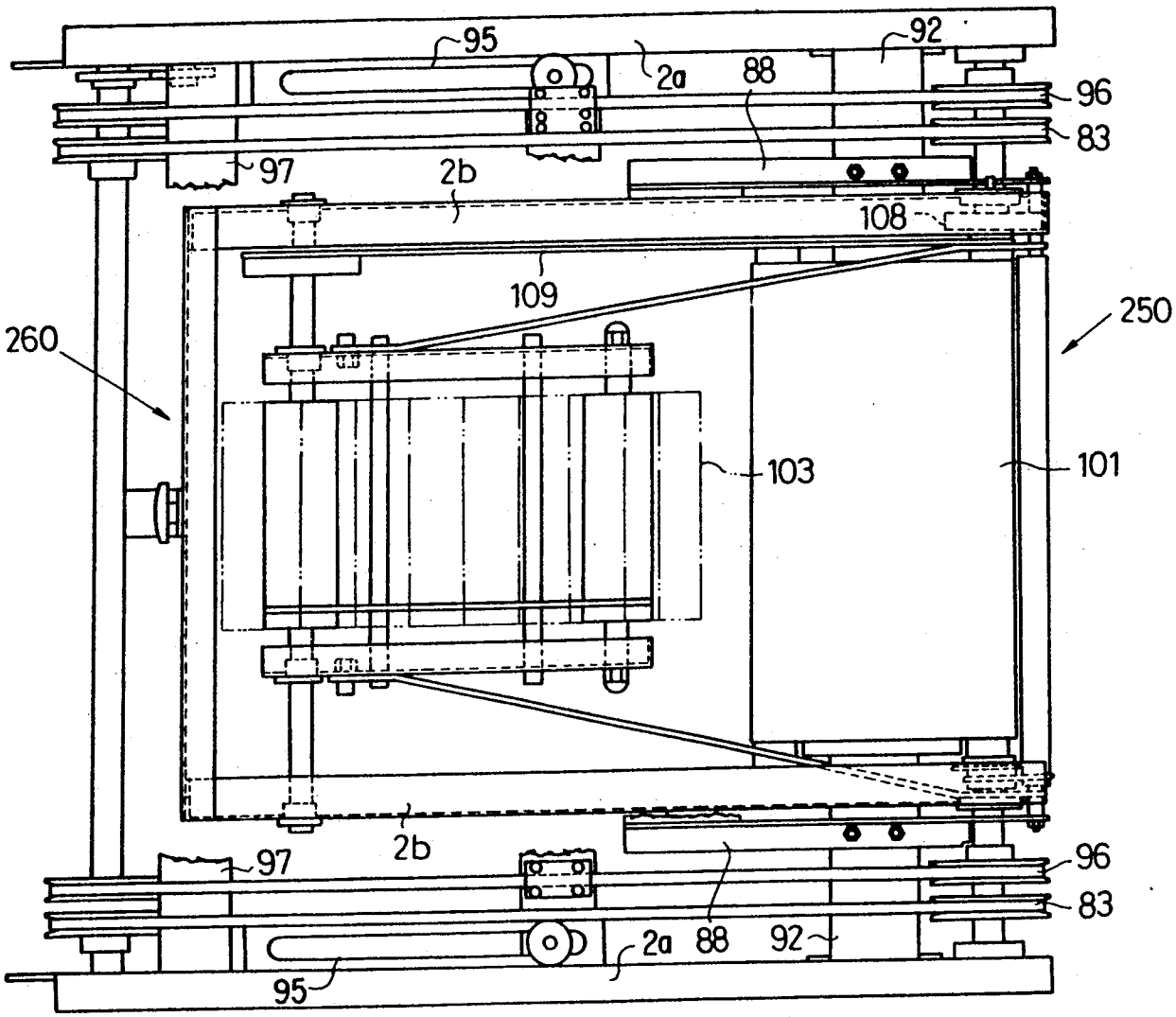
FIG. 11 is a partly cutaway plan view of a material transfer device.

As shown in FIGS. 2 and 10, a film folding device 240 is disposed above the film feeder 230 in the fixed section 2a of the upper frame 2.

This film folding device 240 has a front folder 85, a rear folder 86 and side folding arms 87. Support bars 88 are secured on a mounting plate 92 attached to the fixed section 2a. The front folder 85 comprises front and back pulley bars and 90 supported between both the support bars 88, and a plurality of belts 91 put between the pulley bars 89 and 90. Side end portions of a support plate 93 are supported movable forward and backward on a guide rail 95 attached to the fixed section 2a. The rear folder 86 is a folding roller 94 attached along the front and back edges of this support plate 3.

A belt 96 is set over pulleys 96a provided in the fixed section 2a, and is connected to both side ends of the support plate 93. The side folding arms 87 are supported rotatable, by a shaft 98, with respect to a mounting plate 97 attached to the fixed section 2a. The side folding arms 87 are connected via a linkage 99 and a fixed link 100 to the support plate 93.

When the belt 96 rotates and the rear folder 86 moves closer to and away from the front folder 85, the side folding arms 87 are opened and closed through the linkage 99.

A heater 250 is disposed subsequently in front of the front folder 85 of the film folding device 240. This heater 250 has a rotatable flat belt 101 and a heater plate 102 inserted inward of the belt 101.

As shown in FIGS. 2 and 8, a material transfer device 260 having a rotatable endless conveyor 103 is provided above the film folding device 240 at the pivotable section 2*b* of the frame 2.

As illustrated in FIG. 2, a drive shaft 104 for rotating the belt 96 of the film folding device 240 in the forward and reverse directions is supported on the front end of the lower frame 1. The power of the drive motor 8 of the frame 1 shown in FIG. 3 is transmitted via an interlocking mechanism (not shown) to this drive shaft 104. A drive shaft 105 is supported above the drive shaft 104 on the front end of the lower frame 1, and the rotation of the drive motor 8 is likewise transmitted via an interlocking mechanism (not shown) to the drive shaft 105.

The forward/reverse rotation of the drive shaft 105 is transmitted to the belt 101 of the heater 250 and to the pulley bars 89 of the front folder 85 of the film folding device 240 via the belt 106 shown in FIG. 10. The forward/reverse rotation of the drive shaft 105 is also transmitted to the endless conveyor 103 of the material transfer device 260 via gears 107 and 108 and a belt 109, shown in FIG. 2.

The drive shaft 105 supported on the front end of the lower frame 1 is a pivot for the fixed section 2*a* and pivotable section 2*b* of the upper frame 2.

A control panel 110 attached to the rear end of the fixed section 2*a* of the frame 2 has a temperature detector 111 attached thereto. This temperature detector 111 is connected via the I/O interface 28 to the CPU 29, as shown in FIG. 12, and detects the actual atmospheric temperature T and outputs its detection signal to the CPU 29.

In a program memory 29*a* shown in FIG. 12, the optimal film drawing length according to the width W of a tray 112 and a stop timing for the drive motor 82, which determines the stop position of the movable film holder 44 according to the film drawing length, are stored in advance besides a control program.

Also prestored in the program memory 29*a* is a drive timing Q for the individual solenoids 77 and 78 to make the timing for releasing the film holding of the movable film holder 44 optimal in accordance with a set atmospheric temperature T and the width W and length L of the tray 112.

The drive motor 8 of the material feeder 210 and the brake 56, solenoids 77 and 78 and drive motor 82 of the film feeder are connected via the I/0 interface 28 to the CPU 29, as illustrated in FIG. 12. The CPU 29 controls the driving of both the motors 8 and 82, the brake 56 and the solenoids 77 and 78 as described later, based on detection signals from the rotary encoder 84 as a position detector, the temperature detector 111, the photoelectric switch 26 as a width detector, the photoelectric switch 27 as a length detector and the photoelectric sensor 40 as a film drawing length detecting means.

The wrapping operation of the thus constituted wrapping machine will be described in detail referring to FIGS. 13(*a*) to 13(*e*).

According to the wrapping machine of this embodiment, the tray 112 is supplied in the first step, film folding for the tray 112 is done in the second step, and the tray is transferred in the third step. Further, the supply step, folding step and transfer step for three materials simultaneously progress in this wrapping machine. Each step progresses in response to the signal from the step detector 24.

Figure 13:
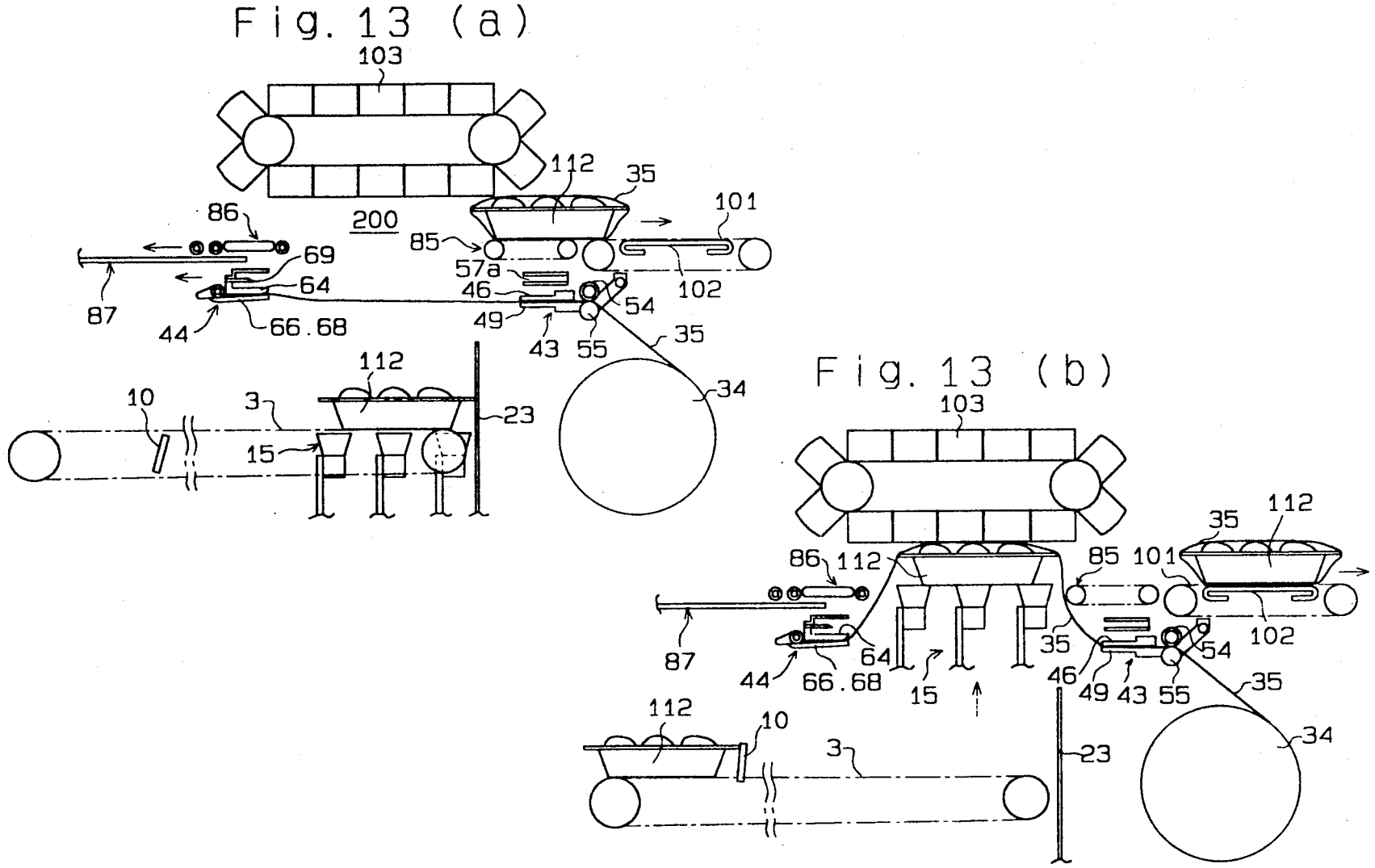
FIGS. 13(*a*) through 13(*e*) are diagrams illustrating a wrapping operation.
Figure 13:
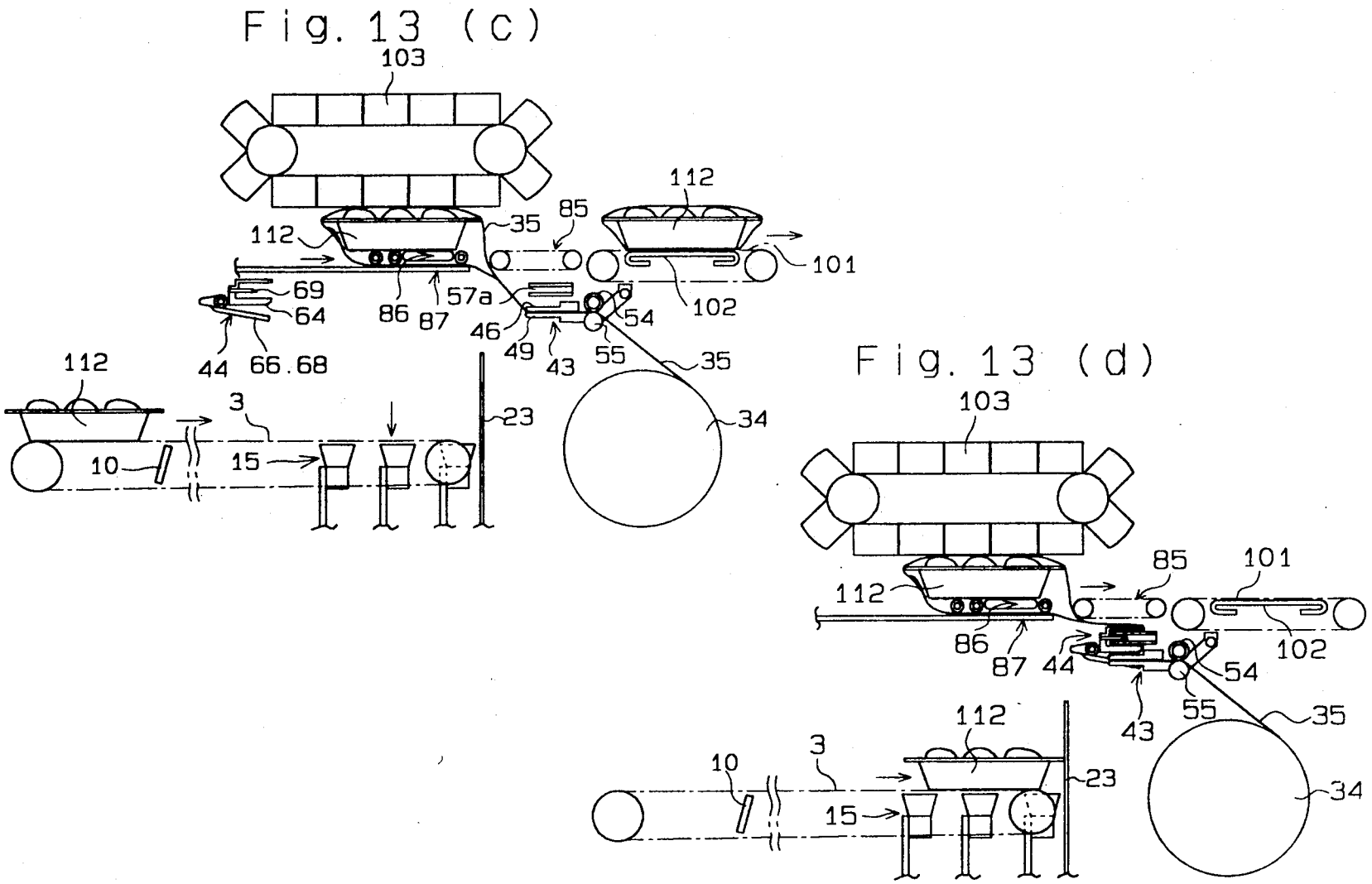
Figure 13:
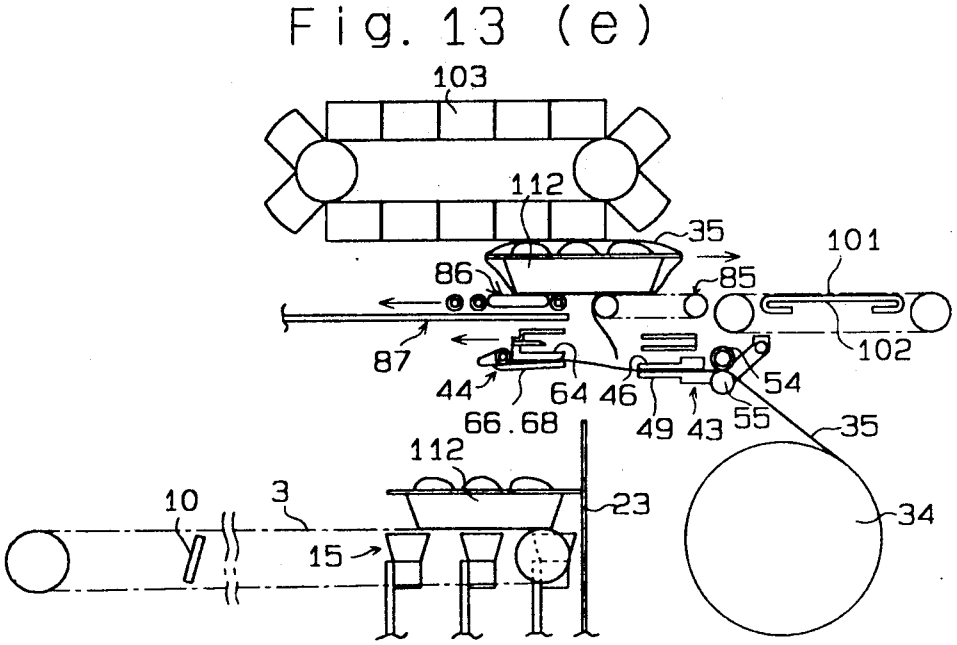

FIG. 13(*a*) illustrates the movable film holder 44 separated from the fixed film holder 44 and the film 35 stretched between the film holders 43 and 44. This state is the start of the folding step. In this state, the film 35 drawn from the film roller 34 passes between the guide rollers 54 and 55 of the fixed film holder 43, and is held between the fixed holding plate 46 of the fixed film holder 43 and the movable film holder 44 by the urging force of the torsion spring 50 and held between the fixed film holding plate 64 of the movable film holder 44 and the movable holding plates 66 and 68. The upper guide roller 54 is rendered unrotatable by the brake 56.

In this state the lift 15 having a material (tray 112 with contents therein) placed thereon moves upward. Then, the film 35 is lifted up to the wrapping portion 200 while being pressed between the upper and lower guide rollers 54 and 55 and between the fixed holding plate 64 and the individual movable holding plates 66 and 68, and is stretched to cover the tray from above, as illustrated in FIG. 13(*b*).

Then, the rear folder 86 comes closer to the front folder 85, at the same time the side folding arms 87 are mutually closed, then, the rear folder 86 and side folding arms 87 go under the tray 112 while folding the film 35. When the tray 112 is lifted up by the rear folder 86 and side folding arms 87, the lift 15 moves down. As shown in FIG. 13(*c*), the film 35 is folded under the tray 112 from the rear and side directions by the rear folder 86 and the side folding arms 87.

At this point of time, the CPU 29 has already received the detection signals from the width detector 26 and length detector 27. Based on the detection signals, the CPU 29 reads out drive timings for the individual solenoids 77 and 78 and drives them in accordance with the drive timings. When the solenoids 77 and 78 are driven, the side movable holding plates 68 of the movable film holder 44 are opened first to release their holding of the sides of the film 35, and the central movable film holding plate 66 is opened to release the center holding of the film 35.

As shown in FIG. 13(*c*), when the holding of the film 35 by the movable film holder 44 is released, the movable film holder 44 moves closer to the fixed film holder 43. After the film 35 is folded by the rear folder 86 and side folding arms 87, the endless conveyor 103 and the belts 91 and 101 of the front folder 85 rotate. When the endless conveyor 103 rotates, the tray 112 is transferred toward the front folder 85 as shown in FIG. 13(*d*) to come onto the belt 91 of the front folder 85. The font folder 85 presses the film 35 under the tray 112. In synchronism with the transfer of the tray 112, the cutter 69 of the movable film holder 44 is fitted in the cutting groove 57*a* of the fixed film holder 43 and the film 35 is pressed into the groove 57*a*, then cut by the cutter 69. After the film 35 is cut, the brake 56 is released to render the upper guide roller 54 rotatable, releasing the holding of the film, 35 and closing the movable holding plates 66 and 68. As a result, the leading edge of the film 35 on the fixed film holder 43 is held by the movable film holder 44.

When the movable film holder 44 moves away from the fixed film holder 43, as shown in FIG. 13(*e*), the film 35 held by the movable film holder 44 is pulled out from the film roller 34, as shown in FIG. 13(*a*). Then, the brake 56 is actuated to hold the film 35 between the guide rollers 54 and 55. At this time, the CPU 29 has already received the detection signals from the width detector 26 and length detector 27, based on which the CPU 29 reads out a drive stop timing P for the drive motor 82 from the program memory 29*a* and stops the motor 82 at the timing P.

When the drive motor 82 stops, the movable film holder 44 also stops moving, and the film 35 held by this holder 44 is drawn from the film roller 34 and is stretched between the film holders 43 and 44, while being pulled by the latter holder 44, as shown in FIG. 13(a). The rear folder 86 moves away from the front folder 85 and the side folding arms 87 are opened.

When the next tray 112 to be wrapped is placed at the central beginning portion on the conveyor 3, as shown in FIG. 13(*b*), the photoelectric switch 9 as an optical sensor detects the tray 112 and the CPU 29 drives the motors 8 and 82 in response to the detection signal of the sensor 9. When the motors 8 and 82 are driven, the wrapping machine is activated and the wrapping cycle starts. Counting of the aforementioned drive timings of the solenoids 77 and 78 and the drive stop timing of the drive motor 82 starts from the beginning of the wrapping cycle.

In the material supply step, the tray 112 is fed to the lift 15 and abuts on the stopper 10 protruding from the conveyor 3 to temporarily stop there.

Figure 5:
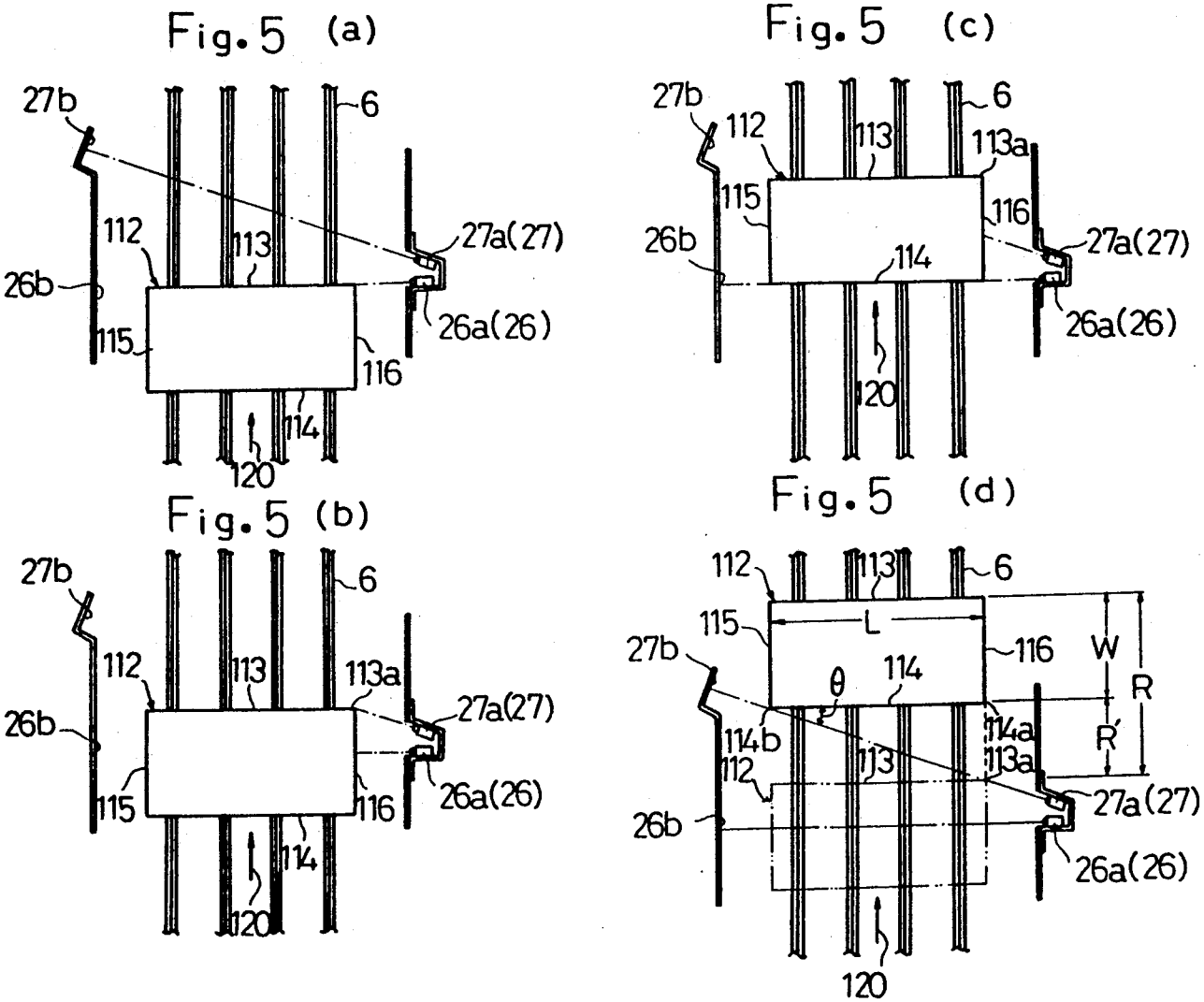
FIGS. 5(*a*) through 5(*d*) are diagrams illustrating an operation of detecting the size of a material.

As shown in FIG. 5, the tray 112 has front and rear sides 113 and 114 extending orthogonal to the material conveying direction 120 and in parallel to each other and left and right sides 115 and 116 extending in parallel to the material conveying direction 120. When the front side 113 of the tray 112 abuts against the stopper 10, the tray 112 is positioned to intersect the material conveying direction 120 at the right angles.

As the lift 15 is set at the lowest material receiving position shown in FIG. 13(*a*) and the stopper 10 retreats under the conveyor 3 in synchronism with that action, the next tray 112 is fed again in the conveying direction 120 to abut on the stopper plate 23, stopping at the end of the conveyor 3, as shown in FIGS. 13(*c*) and 13(*d*).

During the transfer, the front side 113 of the tray 112 crosses a light path of the photoelectric switch 26 (serving as the width detector) as shown in FIG. 5(*a*), this switch 26 is switched off.

When the corner 113*a* between the front side 113 and the right side 116 of the tray 112 crosses the light path of the photoelectric switch 27 (serving as the length detector) as shown in FIG. 5(*b*), the switch 27 is switched off.

When the rear side 114 of the tray 112 passes the photoelectric switch 26 as shown in FIG. 5(c), this switch 26 is set on.

When a corner 114*b* between the rear side 114 and the left side 115 of the tray 112 passes the photoelectric switch 27 as shown in FIG. 5(*d*), this switch 27 is set on.

The CPU 29 receives the detection signal from the photoelectric switch 26 and computes the distance between the front side 113 and rear side 114 of the tray 112 or the width W by a product of the OFF time Ta of the switch 26 and the material transfer velocity V of the conveyor 3.

Further, the CPU computes the distance between the left side 115 and right side 116 of the tray 112 or the length L based on an equation $L=V(Tb-Ta)/\tan\theta$ where Ta and V have the same meanings as defined above and $\theta$ is an inclined angle of light from the photoelectric switch 27.

This equation $L=V(Tb-Ta)/\tan\theta$ can be acquired as follows. Let us consider a right-angled triangle with three sides, as shown in FIG. 5(*d*), the first one connecting the corner 113*a* of the front side 113 of the tray 112 to the corner 114*a* of the rear side 114 of the tray 112 as indicated by the broken line, the second one connecting the corner 113*a*to the corner 114*b* of the rear side 114 as indicated by the solid line and the last one connecting the corners 114*a* and 14*b* as indicated by the solid line. Then, the distance R' between the corners 114*a* and 113*a* equals the difference between the transfer distance of the tray 112, $R=V\times Tb$, and the width of the tray 112, $W=V\times Ta$. Thus, from $\tan\theta=R'/L=(R-W)/L$, $$\begin{aligned} L &= (R-W)/\tan\theta \\ &= (V\times Tb - V\times Ta)/\tan\theta \\ &= V(Tb-Ta)/\tan\theta \end{aligned}$$

can be obtained.

The tray 112 on the front folder 85 is folded from the front side and is placed on the belt 101, so that the tray 112 has its lower folding part heated and sealed by the heat from the heater plate 102.

As the lift 15 elevates upward, the tray 112 is wrapped with the film 35 in the same manner as described above.

In the wrapping machine of this embodiment, the tray 112 is supplied in the first step, is folded in the second step and is transferred in the third step.

Figure 14:
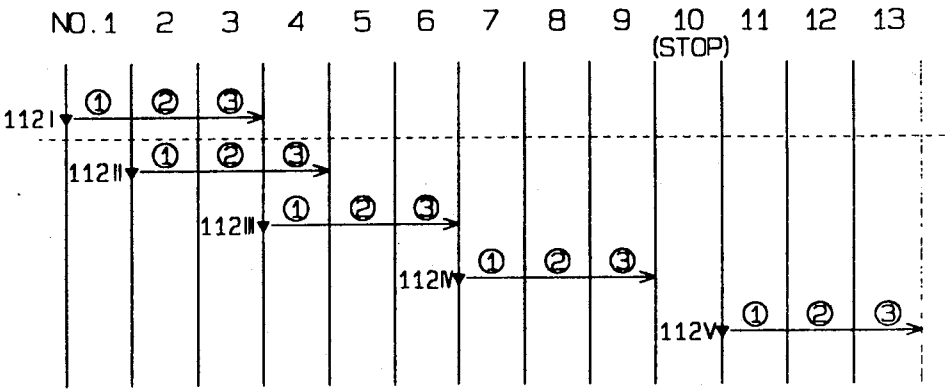
FIG. 14 is a diagram for explaining the wrapping cycle in supplying trays.
Figure 16:
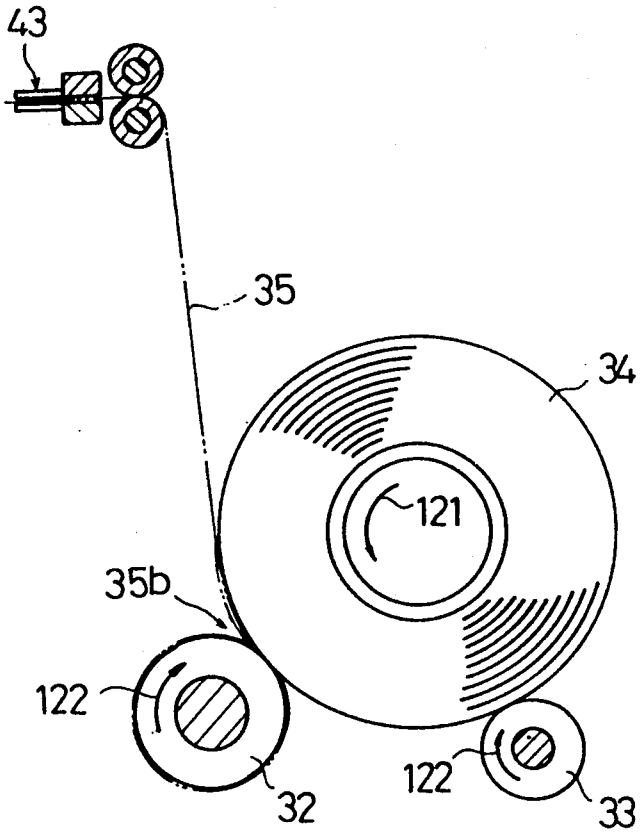
Fig.16 (Prior art)
FIGS. 15 and 16 are longitudinal cross-sectional views showing a film being caught in a conventional film roller support.
Figure 15:
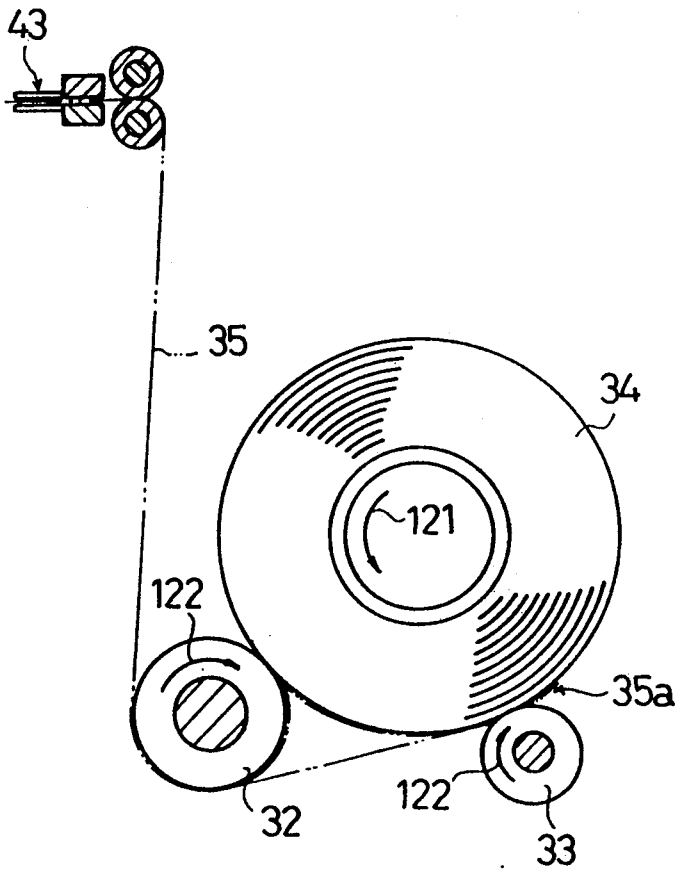
Fig.15 (Prior art)

Particularly in this embodiment, upon detection of the first tray 112 on the conveyor 3 as shown in FIG. 14, the photoelectric switch 9 (the optical sensor) sends a detection signal to the CPU 29 as shown in FIG. 12. Based on this signal, the CPU 29 sends drive signals to both the drive motors 8 and 82 and the solenoids 77 and 78 to start the first step (NO. 1) for the first tray 112.

If the next tray 112 is not supplied even when the third step (NO. 3) of the first tray 112 is completed, the drive signals are sent to the motors 8 and 82 in the second step (NO. 2) for the first tray 112, not to the solenoids 77 and 78. The drawing of the film 35 as shown in FIGS. 13A and E would not therefore be performed. In the third step (NO. 3) for the first tray 112, the drive signal is sent to the motor 8, not to any of the solenoids 77 and 78 and the motor 82, so that neither the drawing of the film 35 as shown in FIGS. 13(a) and 13(*e*), nor the cutting by the cutter 69 as shown in Fig. 13(*d*) is executed.

Further, no drive signals are outputted in the third step for the second tray 112, and the wrapping machine stops functioning.

As shown in FIG. 14, when the second tray 112 is supplied before the second step (NO. 2) for the first tray 112 starts, the individual drive signals are outputted in the first to third steps (NO. 2, 3 and 4) for the second tray 112. In NO. 2, however, the operation for the second tray 112 is given priority over the operation for the first tray 112 and the operation illustrated in FIGS. 13(*a*) to 13(*e*) is performed.

In NO. 3, the operation for the second tray 112 is also given priority over the operation for the first tray 12. In NO. 4, the operation for the second tray 112 is carried out.

Further, as shown in FIG. 14, when the third tray 112 is supplied before the third step (NO. 4) for the second tray 112 starts, and when the fourth tray 112 is fed before the third step (NO. 6) for the third tray 112 starts, the operation for each tray 112 is executed according to the aforementioned priority.

If the fifth tray 112 is not supplied after the third step (NO. 9) for the fourth tray 112 is completed as shown in Fig. 14, no drive signals are sent and the wrapping machine stops functioning (see NO. 10).

Since the fourth tray 112 is always transferred in the third step (NO. 9) before the wrapping machine stops, there is no trays 112 left in the machine. It is therefore unnecessary to perform an operation to transfer trays 112 left in the wrapping machine at the time the wrapping machine stops due to the supplying of the trays being interrupted during activation of the machine.

During the wrapping step, the CPU 29 reads out a predetermined film drawing length from the program memory 29*a* based on the detection signal from the width detector 26, and compares it with the actual film drawing length detected by the photoelectric sensor 40 serving as the film drawing length detecting means. If these film drawing lengths do not coincide with each other, the CPU 29 sends a signal to a drive selector 117 as shown in FIG. 12 to stop the wrapping machine at the initialization of each step. If they coincide with each other, the wrapping machine continues running.

Particularly in this embodiment, as the film roller 34 rotates by the film drawing length of the film 35, the supporting roller 32 on which the film 35 is wound rotates by the film drawing length of the film 35. Because the photoelectric sensor 40 or the length detector detects the rotation of the supporting roller 32 as the number of pulses, the actual film drawing length is detected regardless of a change in the film 35 of the film roller 34.

When the actual film drawing length of the film 35 differs from the film drawing length prestored in accordance with the width W of the tray 112, the wrapping machine stops running at the initialization of each step, so that the trays 112 can be prevented from being transferred, unwrapped or incompletely wrapped.

In particular, according to this embodiment, the timing for releasing the holding of the film 35 by the movable film holder 44 is changed not only in accordance with the size of the tray but also in accordance with the atmospheric temperature, so that the film 35 can be folded under the tray 112 with the optimal tension. In other words, since the film 5 stretches more when the atmospheric temperature is high, the holding of the film 35 is released at an earlier timing; and as the film 35 stretches less at a lower temperature, the holding is released at a delayed timing. Such timing control can apply the optimal tension to the film 35, making it difficult to wrinkle the folded portion of the film 35.

Moreover, according to the embodiment, the guide rollers 54 and 55 conventionally used to guide the film 35 are effectively utilized and the rotation of the guide rollers is controlled by the brake 56, thus eliminating the need for the link mechanism used in the above-described prior art. This simplifies the structure of the film pressing mechanism and makes the film feeder 230 compact.

As the upper guide roller 54 closer to the heater plate 102 is made of cork, it is less affected by heat than this roller 54 being made of plastic, thus reducing the possibility of the film 35 coming in close contact with the roller 54 to be wound therearound.

Further, before the movable film holder 44 holds the film 35 on the fixed film holder 43 and moves away and stops a predetermined distance therefrom, the brake 56 is actuated to permit the guide rollers 54 and 55 to hold the film 35, so that the film 35 can be surely stretched with full tension between the film holders 43 and 44.

In the embodiment, the solenoids 77 and 78 which open and close the movable holding plates 66 and 68 are separated from the movable film holder 44 and are secured. When the movable film holder 44 moves closer to the fixed film holder 43, therefore, the solenoids 77 and 78 do not move together. The solenoids 77 and 78 do not therefore interfere other devices, and the space can be effectively used accordingly, contributing to making the movable film holder 44 compact, which would eventually make the wrapping machine compact.

Since the solenoids 77 and 78 are interlocked with the movable holding plates 66 and 68 through the wires 80 and 81, the rotary shafts 58, the sleeve 59 and the wires 74 and 75, it is possible to effectively use the rotary shafts 58 for supporting the movable film holder 44 movable in the axial direction, thus simplifying the interlocking mechanism.

Since the movable film holder 44 is divided into the central movable holding plate 66 and the side movable holding plates 68, holding of the film 35 by these movable holding plates 66 and 68 can be separately released in accordance with the timing at which the rear folder 86 and side folding arms 87 fold the film 35. Accordingly, the film 35 can be folded with the proper tension high enough not to tear the film 35.

In this embodiment, particularly, once the film 35 is fed from the film roller 34 by the movable film holder 44, the roller 34 rotates on the supporting rollers 32 and 33 in the direction of the arrow 121 in FIG. 7 and the rollers 32 and 33 rotate in the direction of the arrow 122. When the movable film holder 44 stops, the film roller 34 is given the inertial rotational force. As the second supporting roller 33 has a rotational resistance due to the pressing of the coil spring 38, however, the inertial rotation of the film roller 34 decreases, thus reducing the possibility of the film 35 being caught between the film roller 34 and the second guide roller 33.

If the film roller 34 rotates with the inertia, the film 35 between the fixed film holder 43 and the first supporting roller 32 becomes loosen. Since the dividing plate 39 is provided between the film 35 and the film roller 34, however, the film 35 is prevented from contacting the film roller 34 and being caught between the roller 34 and the first supporting roller 32.

Further, according to the embodiment, simple attachment of the photoelectric switch 27 for emitting and receiving light in and from the direction inclined by a predetermined angle $\theta$ to the material conveying direction 120 to the conveyor 3 can permit the CPU 29 to compute the length L of the tray 112. Therefore, not only the length L of the tray 112 can be automatically detected, but also the structure of the size detecting device can be significantly simplified.

According to this embodiment, the material support as illustrated in the description of the prior art is not used, and the tray 112 is placed directly on the belt 6 at the beginning of the conveyor 3. Placing the tray 112 rotates the belt 6, so that the tray 112 is transferred immediately. The tray 112 is stopped by the stopper 10 during its transfer, and is fed again in synchronism with the elevation timing of the lift 15. Therefore, the tray 112 may be placed upon confirmation that the preceding tray 112 is not placed at the beginning of the conveyor 3. Further, the timing of transferring the tray 112 to the lift 15 can be determined by the stopper 10, thus ensuring the transfer of the tray 112 onto the lift 15. According to this embodiment, the mechanism for elevating the lift up and down, comprising the guide rods 12, slide blocks 13, support bar 14, interlocking levers 18, rotary shaft 19, intermediate links 20, cam rollers 21 and cam plates 22, is located on either side of conveyor 3, not thereunder, so that the position of the conveyor 3 can be set lower. This can makes the overall wrapping machine compact as a consequence.

Although the film drawing length is detected through the roller 32 which rotates in direct contact with the film 35 according to the above-described embodiment, it may be detected through a roller which is interlocked with this roller 32.

Although the coil spring 38 is provided only at one of the supporting rollers 32 and 33, namely the roller 33, in the above embodiment, the same mechanism may be provided only at the other supporting roller 32 or at both the rollers 32 and 33.

Although the photoelectric switches 26 and 27 are used respectively as the width detector and length detector in the above embodiment, other sensors, such as ultrasonic sensors may be used as well.

I claim:

1. A wrapping machine comprising:

a wrapping portion for wrapping a material;

a film feeder for feeding a film to the wrapping portion, said film feeder having holding means, including a movable film holder, for holding the film passing therethrough and drive means for permitting the holding means to selectively hold and release the film;

a material feeder for feeding the material to the wrapping portion;

a film folding device for wrapping the material with the film at the wrapping portion;

a sensor for detecting an ambient temperature and outputting a temperature detection signal;

memory means for storing desired drive timings for the film feeder drive means corresponding to various specific temperatures;

driven control means for receiving the temperature detection signal, reading the desired drive timing corresponding to a detected temperature from the memory means, and driving the drive means at the drive timing to release holding of the film by the holding means based upon the retrieved desired drive timing; and an interlocking means provided between the drive means and the holding means which includes a rotary shaft for supporting the movable film holder in an axial direction, an interlocking member movable on the rotary shaft together with the movable film holder and supported rotatable together with the rotary shaft, a first wire for connecting the drive means and the rotary shaft, and a second wire for connecting the interlocking member in a holding portion of the movable film holder.

2. A wrapping machine as recited in claim 1 wherein:

the film feeder has a fixed film holder for supporting a leading edge of the film;

said holding portion is openable and closable for grasping the leading edge of the film supported by the fixed film holder, the movable film holder being movable back and forth relative to the fixed film holder; and the drive means opens and closes the holding portion.

3. A wrapping machine as recited in claim 2 wherein the drive means is separated from the movable film holder.

4. A wrapping machine comprising:

a wrapping portion for wrapping a material;

a film feeder for feeding a film to the wrapping portion, said film feeder having a fixed film holder for supporting a leading edge of the film, a movable film holder having an openable and closable holding portion for grasping the leading edge of the film supported by the fixed film holder, the movable film holder being movable back and forth relative to the fixed film holder, drive means for opening and closing the holding portion, said drive means being separated from the movable film holder, and interlocking means provided between the drive means and the holding portion of the movable film holder for opening and closing the holding portion;

a material feeder for feeding the material to the wrapping portion;

a film folding device for wrapping the material with the film at the wrapping portion;

a material transfer device for transferring the wrapped material;

wherein the holding portion of the movable film holder is divided into a center holding portion and side holding portions on either side thereof;

wherein the interlocking means is divided into a plurality of portions, each interlocking means portions being provided between the drive means and an associated holding portion; and wherein the interlocking means includes a rotary shaft for supporting the movable film holder movably in an axial direction, and interlocking member movable on the rotary shaft together with the movable film holder and supported rotatable together with the rotary shaft, and a second wire for connecting the interlocking member and the holding portion of the movable film holder.

* * * * *